US011713144B2

(12) United States Patent
Vaughn

(10) Patent No.: US 11,713,144 B2
(45) **Date of Patent: *Aug. 1, 2023**

(54) WIRE RELEASE MECHANISM

(71) Applicant: Mark Vaughn, Neosho, MO (US)

(72) Inventor: Mark Vaughn, Neosho, MO (US)

(73) Assignee: Accent Wire Holdings LLC, Tomball, TX (US)

( * ) Notice: Subject to any disclaimer, the term of this patent is extended or adjusted under 35 U.S.C. 154(b) by 376 days.

This patent is subject to a terminal disclaimer.

(21) Appl. No.: 16/918,285

(22) Filed: Jul. 1, 2020

(65) Prior Publication Data

US 2020/0331644 A1 Oct. 22, 2020

Related U.S. Application Data

(63) Continuation-in-part of application No. 15/479,362, filed on Apr. 5, 2017, now Pat. No. 10,737,814.

(60) Provisional application No. 62/319,139, filed on Apr. 6, 2016.

(51) Int. Cl.

| | |
|---|---|
| ***B65B 13/00*** | (2006.01) |
| ***B65B 13/22*** | (2006.01) |
| ***B65B 13/26*** | (2006.01) |
| ***B65B 13/02*** | (2006.01) |

(52) U.S. Cl.
CPC ..... *B65B 13/22* (2013.01); *B65B 13/02* (2013.01); *B65B 13/26* (2013.01)

(58) Field of Classification Search
CPC ..... B65B 13/02; B65B 13/18; B65B 13/26; B65B 13/28; B65B 13/30
See application file for complete search history.

(56) References Cited

U.S. PATENT DOCUMENTS

| | | | | |
|---|---|---|---|---|
| 1,939,746 | A | 12/1933 | Whitman | |
| 8,397,632 | B2 | 3/2013 | Millett et al. | |
| 8,757,055 | B2 | 6/2014 | Millett et al. | |
| 9,045,245 | B2 | 6/2015 | Giett | |
| 2007/0137723 | A1* | 6/2007 | Wiedel | B65B 13/28 140/101 |
| 2013/0247515 | A1 | 9/2013 | Actis | |
| 2015/0066214 | A1 | 3/2015 | Vaughn | |

* cited by examiner

*Primary Examiner* — Debra M Sullivan
(74) *Attorney, Agent, or Firm* — Stephens Juren PLLC; Matthew C Juren; Kelly D Stephens

(57) ABSTRACT

A wire release mechanism for securing an end of a wire during a wire tying cycle. The wire release mechanism may include a wire release portion having an engaging surface and the wire release portion may be movable between an open and closed position.

8 Claims, 17 Drawing Sheets

WIRE RELEASE MECHANISM

CROSS-REFERENCE TO RELATED APPLICATIONS

This application claims priority to U.S. provisional patent application 62/319,139, filed Apr. 6, 2016, which is incorporated by reference herein in its entirety. This application also claims priority to U.S. patent application Ser. No. 15/479,362, filed Apr. 5, 2017, granted on Jul. 22, 2020 as U.S. Pat. No. 10,737,814, which is incorporated by reference herein in its entirety.

STATEMENT REGARDING FEDERALLY SPONSORED RESEARCH

Not applicable.

BACKGROUND OF THE INVENTION

Traditional bulk-material baling machines incorporate a tying system for wrapping and/or securing the baled material, such as a wire tying system. In forming bales of compressible materials, it is important to surround the baled material with a wire having sufficient strength to maintain the form of the compressed bale for shipping and/or storage. At the same time, the wire used to secure a bale must be adequately tensioned by the tying system, as well as securely knotted and/or tied around the bale. In some instances, a wire tying system requires one or more features to securely position at least one end of a wire during knotting/tying, which enables tensioning of the wire and tightening of the strap around the bale. However, traditional hydraulic wire release mechanisms may cause mechanical complications during tensioning of the wire, as well as add to the expense of the overall wire tying system.

The present inventive device is distinguished from the following prior art:

U.S. Pat. Nos. 8,397,632; 9,045,245; and 8,757,055 all relate to wire tying assemblies. The present invention is a wire release mechanism.

U.S. Pat. No. 1,939,746 is a wire tightener, not a wire release mechanism, which could not operate with the current wire composition as used in modem wire tying and release mechanism.

US Pat. App. No. 2015/0251788 to Vaughn discloses a gripping mechanism, not a wire release mechanism as is the present inventive device.

US Pat. App. No. 2013/0247515 to Actis discloses a strap welding system, not a wire release mechanism as is the present inventive device.

U.S. Application No. 61/873,662 to Vaughn discloses a tie Controlling Mechanism, not a wire release mechanism.

SUMMARY

In some of the embodiments the present invention relates to a wire release mechanism that can be mechanically attached to a strapping machine for securing at least one end of a wire applied to a baled material.

Some embodiments of the present invention introduce technology for resolving some issues conventionally experienced when securing a wire strap applied with a bulk-material baling system.

Accordingly, some embodiments of a wire release mechanism for securing at least one end of a wire during a wire tying cycle of a wire tying assembly may include a wire release portion having an engaging surface. In some embodiments, the wire release portion may be affixed to the wire tying assembly such that the wire release portion can move between 1) an open position where the engaging surface is disengaged from, and a first distance away from, at least one end of a wire, and 2) a closed position where the engaging surface may engage, and is a second distance away from, at least one end of a wire during the wire tying cycle.

In some embodiments of the present invention, the wire tying cycle comprises the steps of moving the wire release portion to the closed position, advancing a wire, gripping at least one end of a wire by pressing the wire against the engaging surface with a retractable surface of the wire tying assembly, tying the wire, and moving the wire release portion to the open position to release at least one end of a wire.

In another embodiment of the present invention, the wire release mechanism may include a wire release portion and a gripping arm. In some embodiments, the retractable surface may be included on the gripping arm. The gripping arm may be affixed to the wire tying assembly such that the gripping arm is configured to move between a first position where the retractable surface is disengaged from the wire and a second position where the retractable surface may engage the wire during the wire tying cycle. In this embodiment, the wire tying cycle comprises the steps of moving the gripping arm to the first position, moving the wire release portion to the closed position, advancing a wire, moving the gripping arm to the second position to grip at least one end of a wire by pressing the wire against the engaging surface with the retractable surface, tying the wire, and moving the wire release portion to the open position to release at least one end of a wire.

In another embodiment of the present invention, the wire release mechanism may include the wire release portion and gripping arm, and a base. In this embodiment, the wire release portion is affixed to the base such that the wire release portion can move between the open position and the closed position during the wire tying cycle. In turn, the base is affixed to a wire tying assembly.

In some embodiments of the present invention, the wire release portion may further include a first portion. In one embodiment the engaging surface is located on the first portion. In other embodiments, the first portion may include a lip projecting therefrom and away from a second portion positioned opposite the first portion. The lip may include a first wire flange guide for directing the wire past the engaging surface and may further include the engaging surface. In one embodiment, the lip includes an offset such that the first wire flange guide projects farther from the second portion than does the engaging surface. The offset may include a binding feature (e.g., a corner).

In other embodiments of the present invention, a wire receiving surface may be located on the base or on the wire tying assembly. The wire receiving surface may include a wire channel that may be positioned on the wire receiving surface such that the engaging surface is located adjacent to the wire channel when the wire release portion is in the closed position. In another aspect, the lip may be positioned adjacent to the wire channel when the wire release portion is in the closed position.

In some embodiments of the present invention, the wire receiving surface may also include a second wire guide flange. In this aspect, the second wire guide flange may be located opposite of, and across the wire channel from, the first wire guide flange when the wire release portion is in the closed position.

In one embodiment of the present invention, the wire release portion may be hingedly affixed at the second portion to a pivot yoke. The pivot yoke may be affixed to the base, integrated within the base, and/or integrated within the wire tying assembly. In this embodiment, the gripper block may rotate around the pivot yoke from the open position to the closed position. In other embodiments, the wire tying assembly includes a rotating arm that may couple to the wire release portion and actuate the wire release portion between the closed position and the open position. In this embodiment, the rotating arm moves between a forward arm position and a rearward arm position.

In another embodiment of the present invention, the gripping arm is actuated between the first position and the second position by a hydraulic arm. In some embodiments of the present invention, the hydraulic arm may be coupled to the hydraulic system of the wire tying assembly. In some embodiments of the present invention, the hydraulic arm may be supplied hydraulic fluid by a common hydraulic circuit corresponding to at least a portion of the wire tying assembly that applies a tying force to the wire. In some embodiments, the retractable surface may be located on an end of the hydraulic arm. In other embodiments, the gripping arm may be rotatably affixed to the wire tying assembly at a pin.

In several embodiments, the present invention is a wire release mechanism comprising: a gripper lever; a gripper pivot bolt; a gripper yoke; a hinged gripper with an engagement face; a cutter lever arm; a cutter yoke; a cutter shaft; a cylinder; a twister pinion with outer teeth, a hollow interior and an ingress portion; pinion bushings; and a wire guide; wherein said gripper lever is in mechanical and rotatable communication with said gripper pivot bolt and is actuated into movement about said gripper pivot bolt by said cylinder; said hinged gripper is in mechanical and rotatable communication with said gripper yoke; said twister pinion with outer teeth, a hollow interior and an ingress portion is rotatable and in mechanical communication with said pinion bushings; and said a cutter lever arm is in mechanical communication with said cutter yoke and said cutter shaft wherein movement of said cutter lever arm will rotate said cutter shaft. In several embodiments, said wire release mechanism is in mechanical communication with a wire tying assembly. In several embodiments, said gripper lever is rotated into an open position about said gripper pivot bolt by the expansion of said cylinder. In several embodiments, said gripper lever is rotated into a closed position about said gripper pivot bolt by the retraction of said cylinder. In several embodiments, said hinged gripper with an engagement face is in a closed position relative to said gripper yoke in which said hinged gripper with an engagement face has the engagement face substantially parallel to the gripper yoke. In several embodiments, said hinged gripper with an engagement face is in a closed position relative to said gripper yoke in which said hinged gripper with an engagement face has the engagement face at an angle to the gripper yoke. In several embodiments, said ingress portion allows for a wire to egress said twister pinion. In several embodiments, the wire release mechanism further comprises a set of pushing arms; wherein said pushing arms can push a wire out of said ingress portion.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

For a more complete understanding of the present disclosure and the advantages thereof, reference is now made to the following descriptions to be taken in conjunction with the accompanying drawings describing specific embodiments of the disclosure, wherein.

DETAILED DESCRIPTION OF THE INVENTION

Figure 1A:
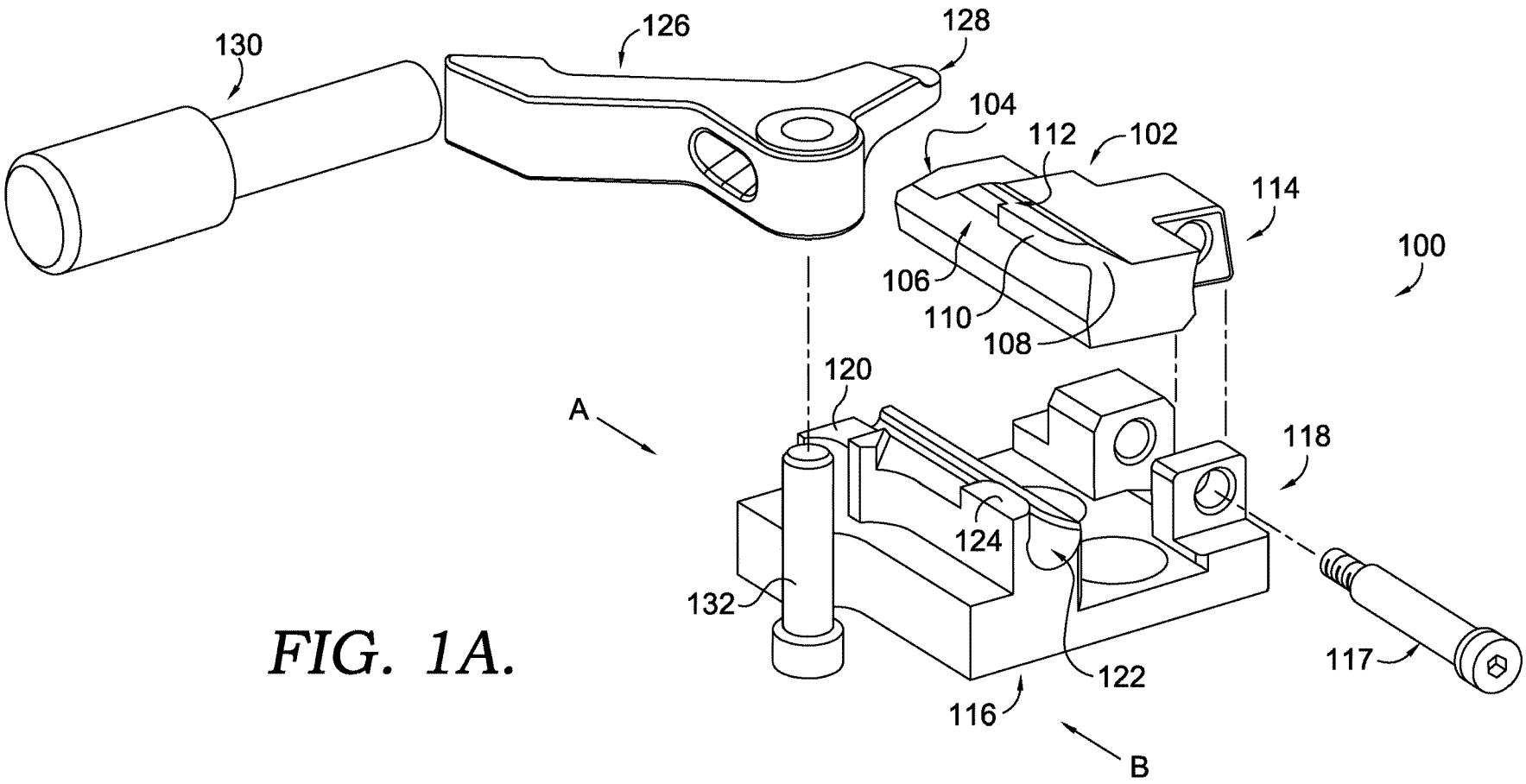
FIG. 1A is an exploded bottom view of the first end of a wire release mechanism for bulk-material baling, in accordance with an embodiment of the invention.

One or more illustrative embodiments incorporating the invention disclosed herein are presented below. Applicant has created a revolutionary wire release mechanism.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 2020. Definitions and/or interpretations should not be incorporated from other patent applications, patents, or publications, related or not, unless specifically stated in this specification or if the incorporation is necessary for maintaining validity. The term "yoke" as used herein is defined as "a clamp or vise that holds a machine part in place or controls its movement or that holds two such parts together." The term "cutter" as used herein is defined as "any tool that is used to remove some material from the work piece by means of shear deformation." The term "gripper" as used herein is defined as "a device which enables the holding of an object to be manipulated." The term "pivot" as defined herein is "the central point, pin, or shaft on which a mechanism turns or oscillates."

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

In several embodiments, the present invention may generally relate to a wire release mechanism 100 for use on a strapping machine. More particularly, some embodiments of the present invention relate to a wire release mechanism 100 coupled to a wire tying system of a strapping machine, for securing and ejecting at least one end of a wire applied to a baled material.

For example, the wire release mechanism 100 can be used to secure a wire around a bale of recycled material during knotting of the wire and eject the wire after knotting is complete. As such, embodiments of the wire release mechanism can be coupled to and/or adjacent to a wire tying system of a strapping machine for baling bulk material.

Figure 1B:
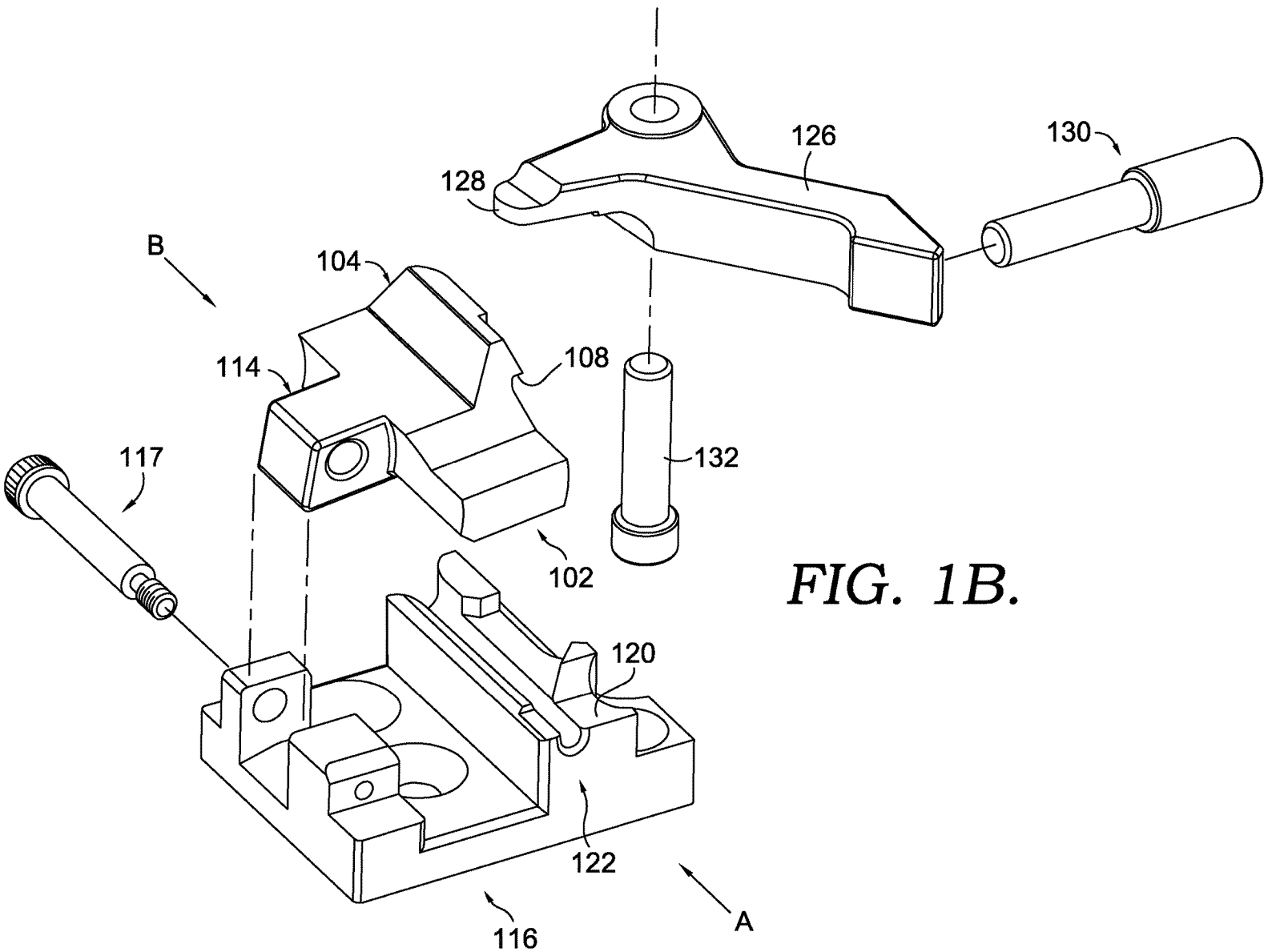
FIG. 1B is an exploded bottom view of the second end of the wire release mechanism of FIG. 1A, in accordance with an embodiment of the invention.

Referring initially to FIGS. 1A and 1B, exploded, bottom views are illustrated depicting an exemplary embodiment of a wire release mechanism 100. In some embodiments, the wire release mechanism 100 is removably coupled to at least a portion of a wire tying assembly (not shown), such as at an end of the wire tying assembly. FIGS. 1A and 1B include viewpoint A and viewpoint B illustrating opposing views of the wire release mechanism 100. Viewpoint A substantially depicts the wire release mechanism 100 from the external side of the end of the wire tying assembly (not shown) where a wire 30 is retained during tying and begins to exit the wire release mechanism 100. Additionally, viewpoint B substantially depicts the wire release mechanism 100 from the internal side of the end of the wire tying assembly (not shown), where the gripped end of the wire 30 enters the wire release mechanism 100.

In one embodiment, the illustrated wire release mechanism 100 includes a wire release portion 102 hingedly affixed to a base 116 at a pivot yoke 118 and a gripping arm 126. The base 116 may be affixed to a wire tying assembly (not shown). The wire release portion 102 may rotate about the pivot yoke 118 between the open position (see FIG. 7 for example) and the closed position (see FIG. 8 for example). The illustrated wire release portion 102 has a first portion 104 opposite a second portion 114. The first portion 104 depicted in FIGS. 1A and 1B includes a lip 108 projecting therefrom and away from the second portion 114. The exemplary lip 108 includes a first wire guide flange 110 spaced apart from an engaging surface 106 by an offset 112.

Figure 8:
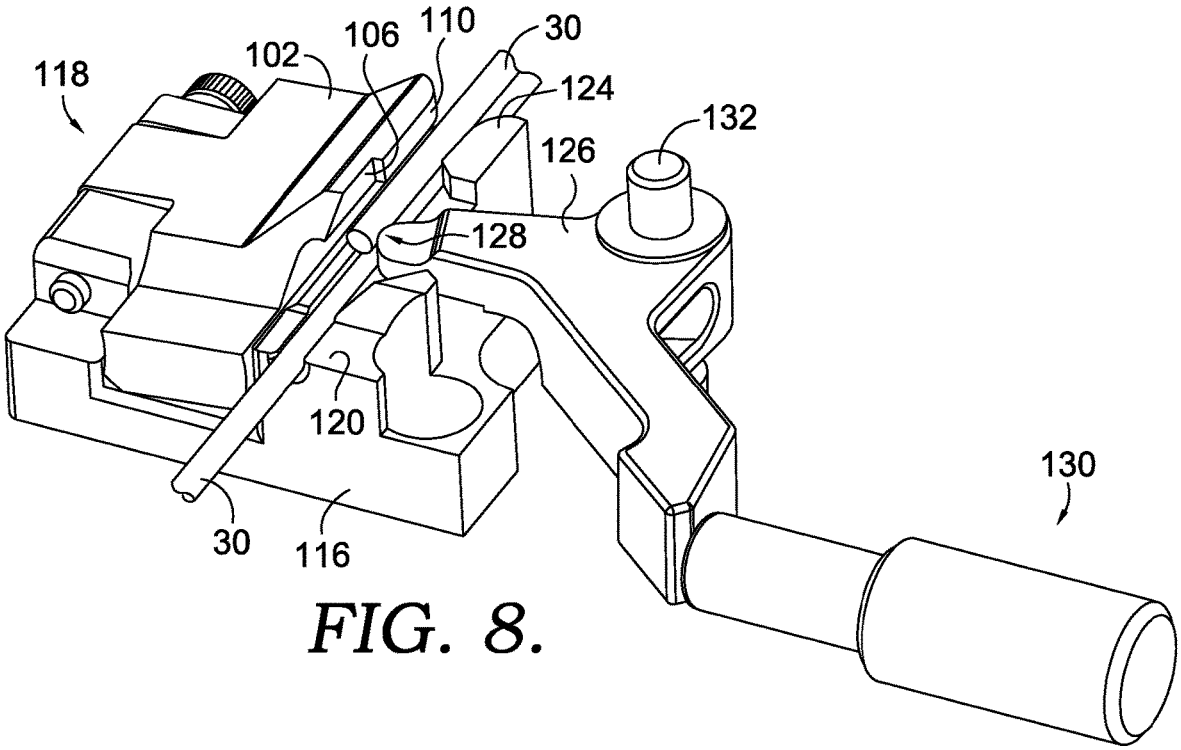
FIG. 8 is a perspective, bottom view of an exemplary wire release mechanism having a wire release portion in a closed position and a gripping arm in an open position, in accordance with an embodiment of the invention.

In one embodiment of the present invention, the first wire guide flange 110 directs at least one end of a wire to a point adjacent to the engaging surface 106. In several embodiments, the illustrated offset 112 permits the gripping arm 126 to press a portion of at least one end of a wire against the engaging surface 106 and farther towards the second portion 114 than a portion of at least one end of a wire adjacent to the first wire guide flange (as shown in FIG. 8). In this configuration, the offset 112 corner provides additional resistance against the wire 30 being ungripped by the wire release mechanism 100, according to embodiments of the invention.

In one embodiment of the present invention, the illustrated second portion 114 of the wire release portion 102 may be affixed to the base 116 at the pivot yoke 118. As disclosed in the bottom view perspective, the wire release portion 102 may be rotatably affixed via the pivot yoke 118 such that when not physically retained against the base 116, the wire release portion 102 drops (i.e., via gravity) into an open position. In several embodiments, a coupling mechanism 117 (e.g., a pin structure or a hinge assembly) may secure the wire release portion 102 to the base 116 such that rotation at the moveably coupled pivot yoke 118 and second portion 114 permits opening and closing of the wire release mechanism 100.

Figure 2:
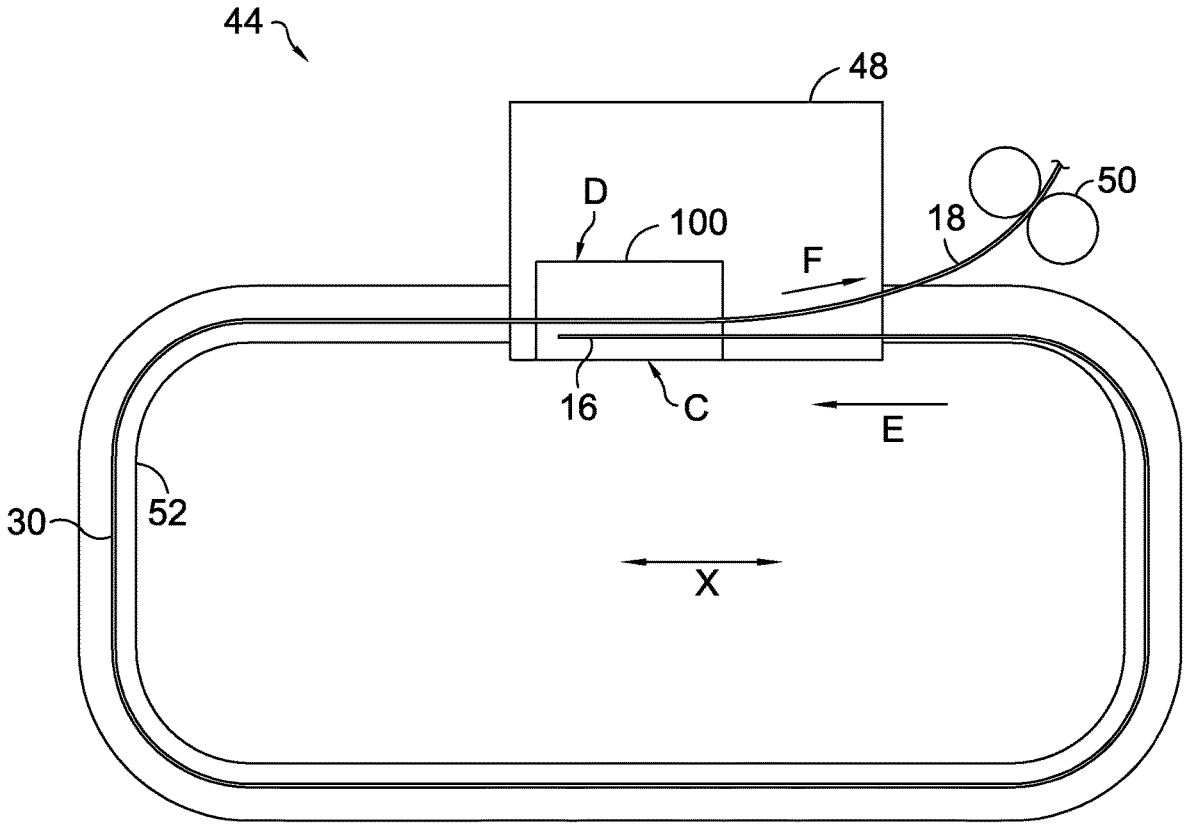
FIG. 2 is a schematic side view of an exemplary strapping machine having a wire release mechanism and a wire tying system, in accordance with an embodiment of the invention.

In several embodiments of the present invention, the exemplary base 116 further comprises a wire channel 122 set inside and/or extending along a wire receiving surface 120. As the loop of wire 30 is drawn around the baling apparatus (as described below and as depicted in FIG. 2), the wire 30 initially passes the wire release mechanism 100 a first time and continues around the baling apparatus until the end of the wire 30 returns around the loop and again passes the wire release mechanism 100 to the point the wire 30 is to be gripped. The wire channel 122 receives the wire 30 as it passes the wire release mechanism 100 the first time.

In several embodiments of the present invention, the illustrated base 116 further includes a second wire guide flange 124 positioned adjacent to the wire channel 122. In one embodiment of the invention, the second wire guide flange 124 directs at least one end of a wire to the point adjacent to the engaging surface 106. In some embodiments, the second wire guide flange 124 is positioned across the wire channel 122 from the first wire guide flange 110.

Figure 9:
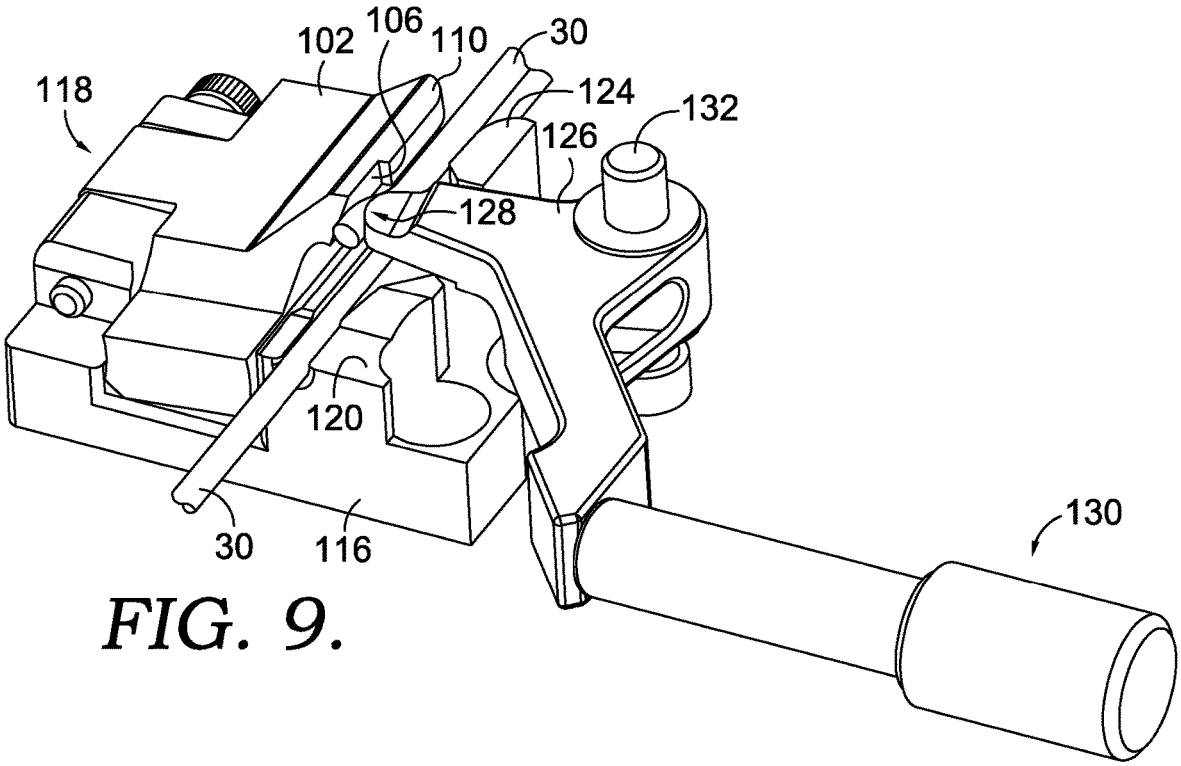
FIG. 9 is a perspective, bottom view of an exemplary wire release mechanism having a wire release portion in a closed position and a gripping arm in a closed position, in accordance with an embodiment of the invention.

In one embodiment of the present invention, the gripping arm 126 maybe coupled to the wire tying assembly by a pin 132 and hydraulically actuated by a hydraulic arm 130 that may rotate the gripping arm 126 around the pin 132 between the first position (e.g., FIG. 8) and the second position (e.g., FIG. 9). The hydraulic arm 130 may be coupled to a hydraulic system of the wire tying assembly and may be in fluid communication with a common hydraulic circuit that is shared with a portion of the wire tying assembly that applies a tying force to the wire 30.

In several embodiments, the common hydraulic circuit may provide hydraulic fluid to the hydraulic arm 130 such that the force applied by the hydraulic arm 130 through the gripping arm 126 to the wire 30 increases in proportion to the force applied by the portion of the knotting assembly that applies a tying force. As such, a threshold amount of force applied by the gripping arm 126 at its retractable surface 128 against at least a portion of a wire 30 positioned between the gripping arm 126 and the engaging surface 106 of the wire release portion 102, provides a threshold amount of force for the wire release mechanism 100 securing the wire 30 during wire tying and tensioning.

Several embodiments of the wire release mechanism 100 may be configured for use with a wire tying assembly for tying a wire strap around a baled material. The wire tying assembly may be, but is not limited to, the knotter assembly described in one or more of the following patents: U.S. Pat. Nos. 8,397,632; 9,045,245; and 8,757,055. Other wire tying assemblies can be used as known in the art.

Additionally, in several embodiments, the wire tying assembly used with wire release mechanism 100 may include a control system coupled directly or indirectly to the wire tying assembly. For example, a strapping machine of a wire tying system may include a common control system configured to control at least a portion of the wire tying mechanism and/or related components, such as the control system described in U.S. Application No. 61/873,662, filed Sep. 4, 2013, entitled "Control User Interface For Tying System", the disclosure of which his hereby incorporated by reference in its entirety.

As shown in the exemplary side view of FIG. 2, in some embodiments, a loop of wire 30 is formed around a baling apparatus 44, which includes a wire release mechanism 100 coupled to a wire tying assembly 48 (e.g., a knotter assembly), and a tensioning mechanism 50. In some embodiments, tensioning mechanism 50 may include any number of features for use during tensioning of a wire 30 with a wire tying system, as is shown in the example of FIG. 2 with adjacent feed wheels for illustrative purposes only. When viewed from the side, the bottom side C of the wire release mechanism 100 is facing downward, while the top side D of the wire release mechanism 100 is oriented in the opposite direction. In embodiments, during loading of the baling apparatus 44 with wire 30, the first end 16 of the wire 30 enters the track 52 of the baling apparatus 44 in the first direction E, travels around a perimeter of the track 52, and returns through the wire tying assembly 48 to the wire release mechanism 100.

As such, when viewed from the bottom side C of the wire release mechanism 100 (i.e., the bottom view of FIGS. 7-10, and 16), the wire 30 is retained and/or layered within the wire release mechanism 100 such that the first end 16 is closest the bottom side C, and the second end 18 is closest the top side D. Accordingly, the wire release mechanism 100 is configured to secure the first end 16 of the wire 30 during application of tension by the tensioning mechanism 50. In some embodiments, in response to tension applied by the tensioning mechanism 50 in the second direction F, travel of the first end 16 of the wire 30 is restricted by the wire release mechanism 100.

Figure 3:
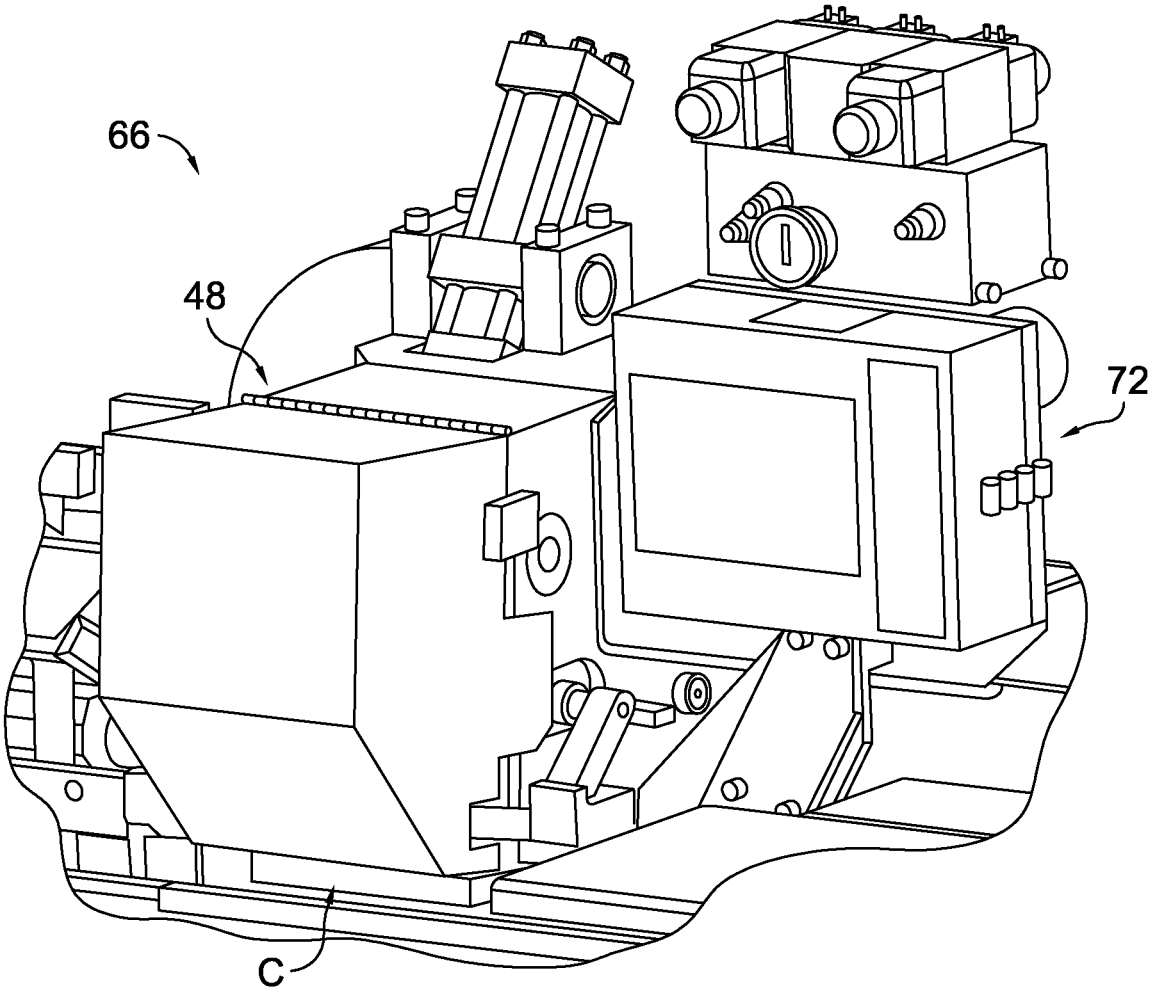
FIG. 3 is a perspective view of an exemplary wire tying system, in accordance with an embodiment of the invention.

As shown in the embodiment illustrated in FIG. 3, a wire tying system 66 may include a wire tying assembly 48 coupled to a control mechanism 72. In embodiments, the control mechanism 72 is configured to control one or more components of the wire tying system 66. In response to tying and/or knotting of the wire 30 by the wire tying assembly 48, at least a portion of the wire 30 secured by the wire release mechanism 100 may be released by the wire release mechanism 100 and/or wire tying assembly 48. In embodiments, the wire release mechanism 100 may be in contact with a wire tying assembly 48, such as a removable component including one or more wear parts of a wire tying assembly 48.

Figure 4:
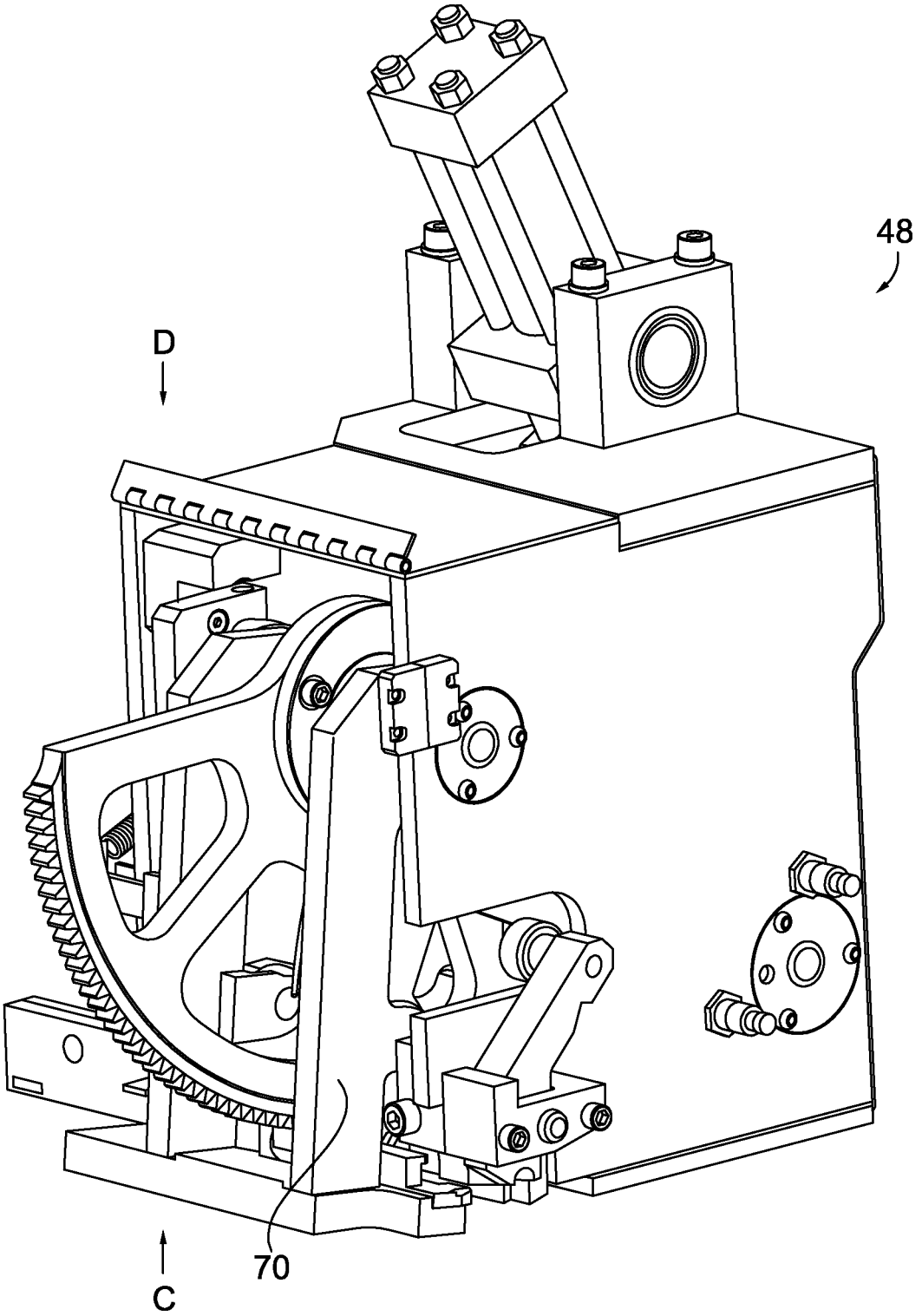
FIG. 4 is a perspective view of an exemplary wire tying assembly with the face plate removed and having a rotating arm in a rearward position, in accordance with an embodiment of the invention.
Figure 5:
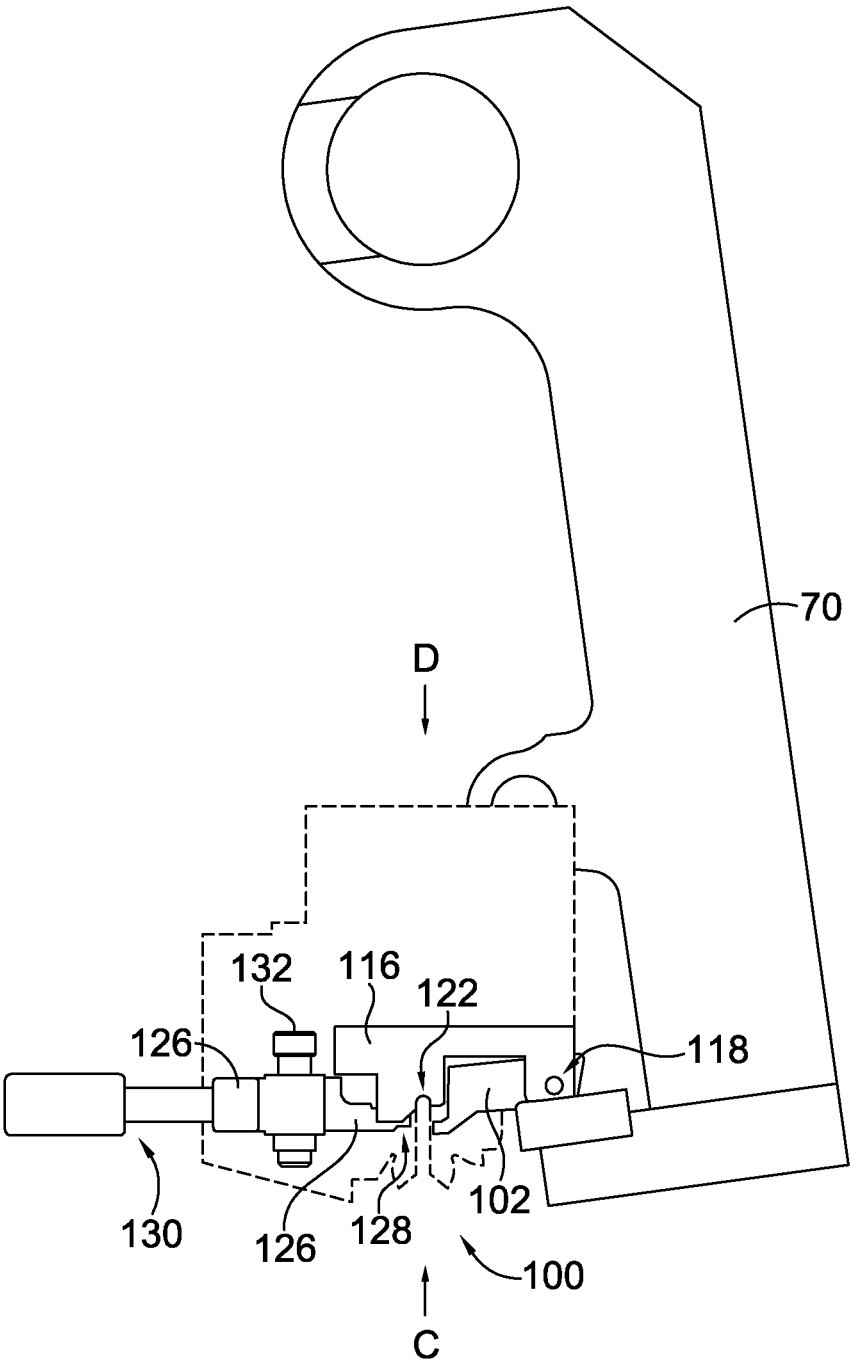
FIG. 5 is a side elevation view of an exemplary wire release mechanism having a rotating arm in a rearward arm position, a wire release portion in an open position, and a gripping arm in an open position, in accordance with an embodiment of the invention.
Figure 6:
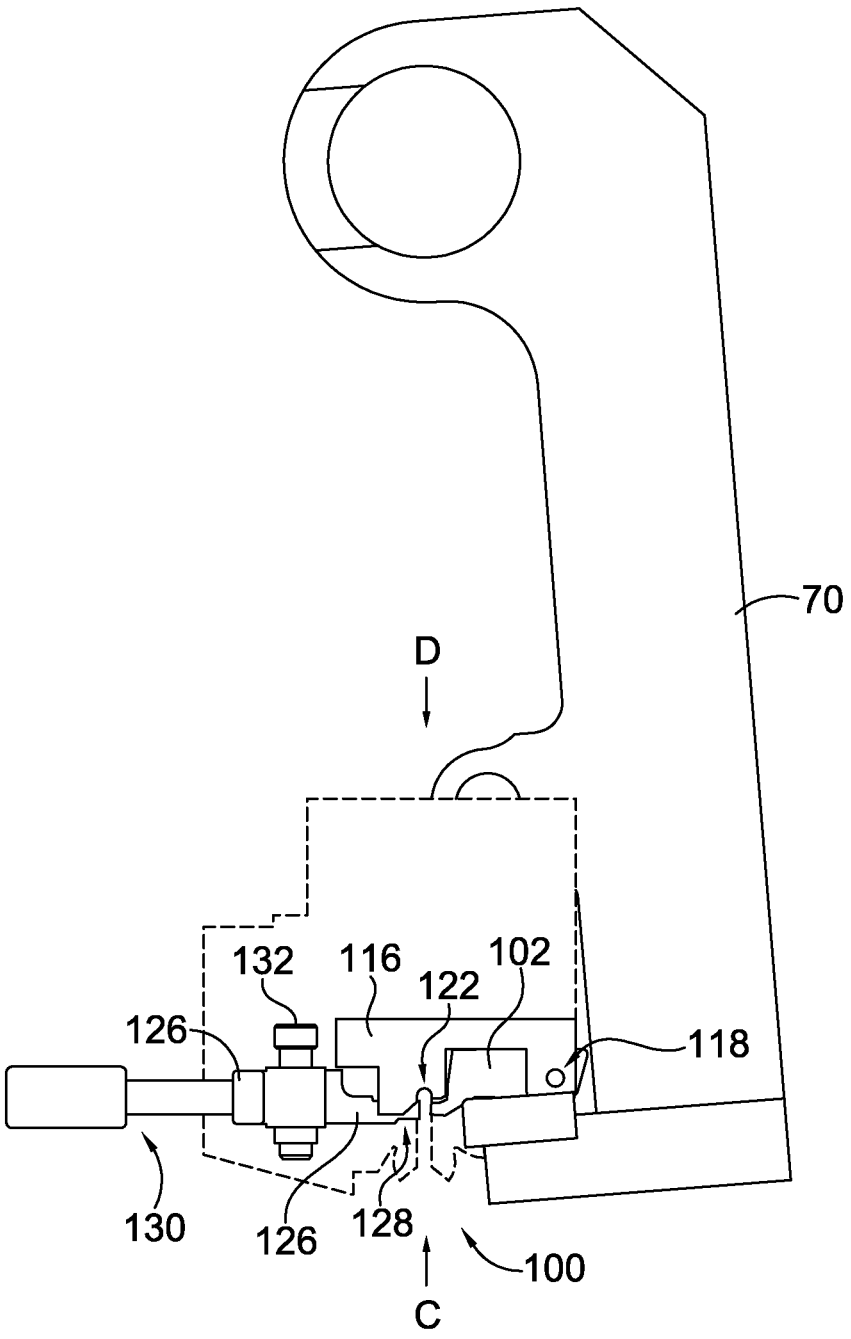
FIG. 6 is a side elevation view of an exemplary wire release mechanism having a rotating arm in a forward arm position, a wire release portion in a closed position, or partially closed position, and a gripping arm in a closed position, or partially closed position, in accordance with an embodiment of the invention.

In further embodiments illustrated in FIGS. 4-6, the wire release mechanism 100 may be in contact with the removable component and may be activated in response to one or more parts of the wire tying assembly 48, such as by contact with at least a portion of the rotating arm 70 of the wire tying system. As depicted in FIG. 4, one embodiment of the wire tying assembly 48 comprising a knotter assembly is illustrated having its face plate removed to expose the internal components of the knotter assembly. One of the internal components of the illustrated embodiment includes the rotating arm 70. The rotating arm 70 is depicted in the rearward arm position. The wire release mechanism 100 is not shown in FIG. 4 because it is positioned on the bottom side C and cannot be seen in the illustrated perspective.

In some embodiments, the rotating arm 70 may be moved between the rearward arm position (as illustrated in FIG. 5) and a forward arm position (as illustrated in FIG. 6). For example, FIG. 5 illustrates a side view of one embodiment of the present invention and depicts the rotating arm 70 in the rearward arm position and the wire release portion 102 in the open position. Further depicted is the gripping arm 126 in the first position and the hydraulic arm 130 in a retracted position. In the illustrated embodiment, the rotating arm 70 is positioned adjacent to the wire release portion 102, but is not mechanically coupled to the wire release portion 102. Hence, in the illustrated embodiment where the wire release mechanism 100 is positioned on bottom side C and the rotating arm 70 hinges from top side D, the wire release portion 102 may fall to the open position by gravity when the rotating arm 70 is moved to the rearward arm position.

FIG. 6 illustrates a side view of one embodiment of the present invention and depicts the rotating arm 70 in the forward position and the wire release portion 102 in the closed position. Also depicted is the gripping arm 126 in the first position and the hydraulic arm 130 in an extended position. In the illustrated embodiment, the rotating arm 70 is positioned adjacent to the wire release portion 102, but is not mechanically coupled to the wire release portion 102. Hence, in the illustrated embodiment where, the wire release mechanism 100 is positioned on bottom side C and the rotating arm 70 hinges from top side D, the wire release portion 102 may be pressed from bottom side C towards top side D by the rotating arm 70 when the rotating arm 70 is moved to the forward arm position. In some embodiments, FIG. 6, is in a slightly, or partially open position, therein allowing for further demonstration of several embodiments of the present invention.

Figure 7:
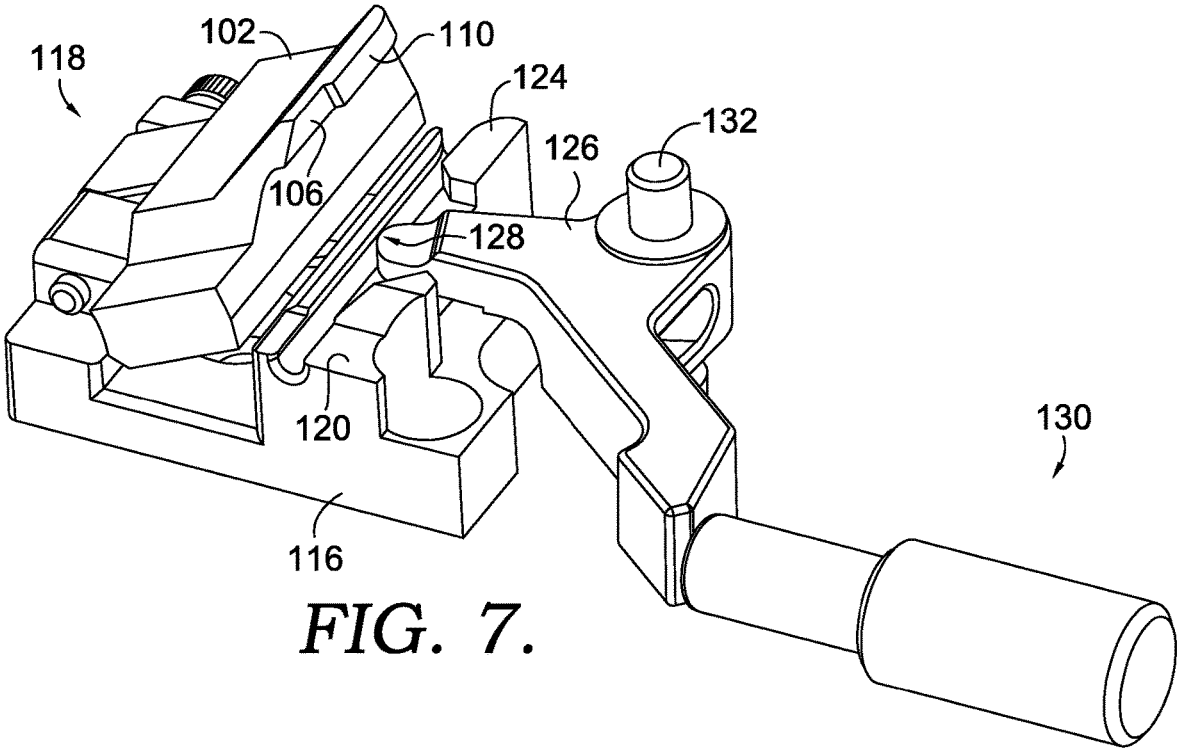
FIG. 7 is a perspective, bottom view of an exemplary wire release mechanism having a wire release portion in an open position and a gripping arm in an open position, in accordance with an embodiment of the invention.

In some embodiments, the positioning of the wire release mechanism 100 during an exemplary wire tying cycle is described in reference to FIGS. 7-10. An exemplary wire tying cycle may include the steps of moving the retractable surface 128 to the first position (as illustrated in FIG. 7) and moving the wire release portion 102 to the closed position (as illustrated in FIG. 8). The wire release portion 102 may be moved into the closed position of exemplary FIG. 8 based on one or more forces applied by one or more features of a wire tying system. For example, a rotating arm 70 may be mechanically coupled to the wire release portion 102, such that when the rotating arm 70 moves between the forward arm position and the rearward arm position, the mechanical coupling forces the wire release portion 102 to move between the closed position and open position. In another aspect, the rotating arm 70 may be positioned adjacent to the wire release portion 102, such that when the rotating arm 70 moves from the rearward arm position to the forward arm position, the rotating arm 70 contacts the wire release portion 102 and moves the wire release portion 102 to the closed position. Similarly, in one aspect, when the rotating arm 70 moves from the forward arm position to the rearward arm position, the contacted wire release portion 102 may be allowed to move to the open position. The contacted wire release portion 102 may move to the open position by mechanical coupling, by gravity, or by another the central point, pin, or shaft on which a mechanism turns or oscillates means.

In further aspects of the wire tying cycle, a wire 30 provided through the track 52 of a wire tying apparatus is carried along the track 52 (as depicted in FIG. 2) and advanced into the wire channel 122, looped around the track 52, and back between the first wire guide flange 110 and second wire guide flange 124 to the point adjacent to the engaging surface 106 of FIG. 9.

In further aspects of the wire tying cycle, the gripping arm 126 is moved to the second position, as illustrated in FIG. 9, to secure at least one end of a wire between the retractable surface 128 and the engaging surface 106. These aspects are further illustrated in FIG. 6 where a rotating arm 70 is moved to a forward arm position, which thereby holds the adjacent wire release portion 102 in the closed position and the retractable surface 128 is extended to the second position to engage the wire 30 (not shown). In one aspect, the retractable surface 128 engages the wire 30 when the gripping arm is moved to the second position. In one embodiment, the hydraulic arm 130 extends to move the gripping arm 126 into the second position. Once the wire 30 is gripped, by the wire release mechanism 100, the wire 30 is tied by the wire tying assembly 48.

Figure 10:
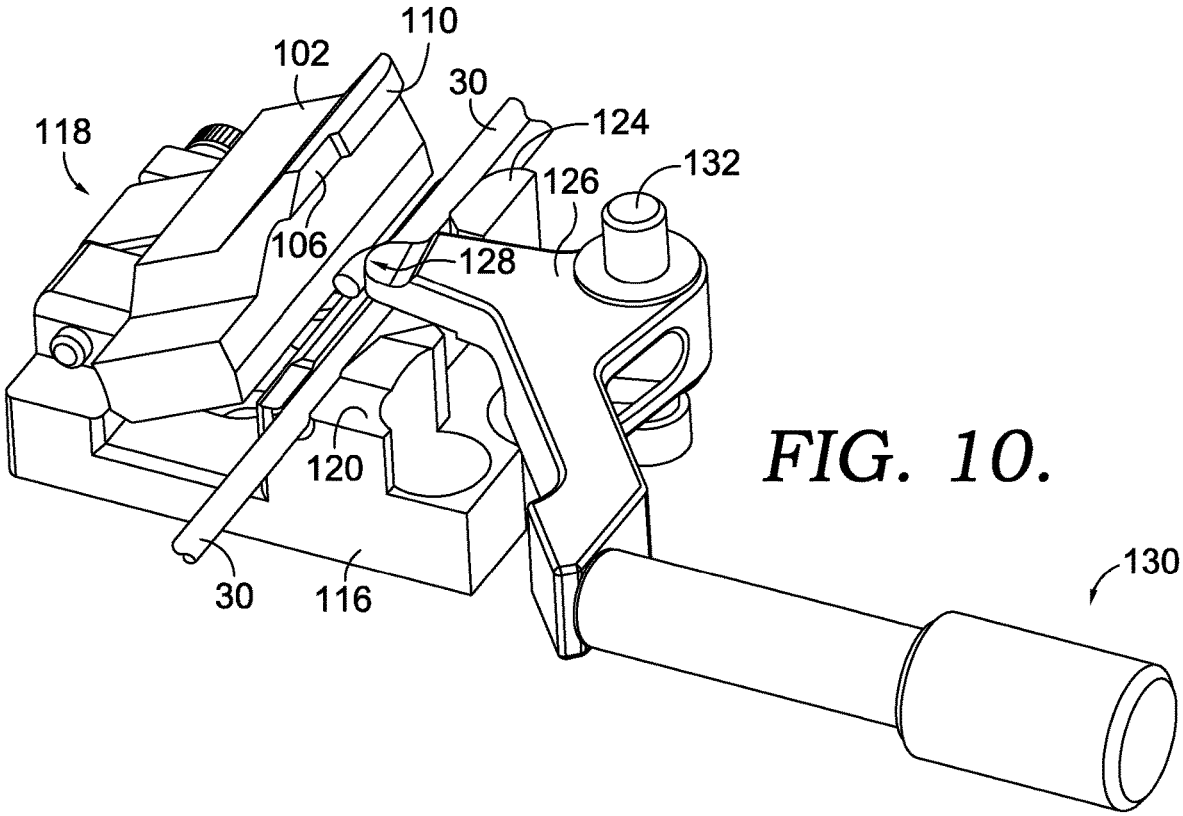
FIG. 10 is a perspective, bottom view of an exemplary wire release mechanism having a wire release portion in an open position and a gripping arm in a closed position, in accordance with an embodiment of the invention.

In further aspects of the wire tying cycle, and as further illustrated in the example of FIG. 10, after the wire 30 secured by the wire release portion 102 and the gripping arm 126 of the wire release mechanism 100 has been tied by the wire tying assembly 48, the wire release portion 102 may be moved to the open position to release/eject at least one end of a wire 30. Such open position of the wire release portion 102 in this configuration may correspond to one or more positions of the wire tying assembly 48, such as the rearward arm position. By the wire release portion 102 moving from the closed position (FIGS. 8 and 9) to the open position (FIG. 10), the wire 30 is released by the wire release mechanism 100, and the engaging surface 106 and the retractable surface 128 are disengaged from the wire 30 once a wire tying cycle is completed.

As described above, in some embodiments, several of the components included herein, such as the base 116, the gripping arm 126, the retractable surface 128, and the hydraulic arm 130, may be integrated within, or associated with, one or more features of a wire tying assembly 48. In such embodiments, wire tying cycles similar to the exemplary wire tying cycle described above are contemplated where the non-integrated components of the wire release mechanism 100 work in concert with the integrated components in the wire tying assembly.

Figure 11:
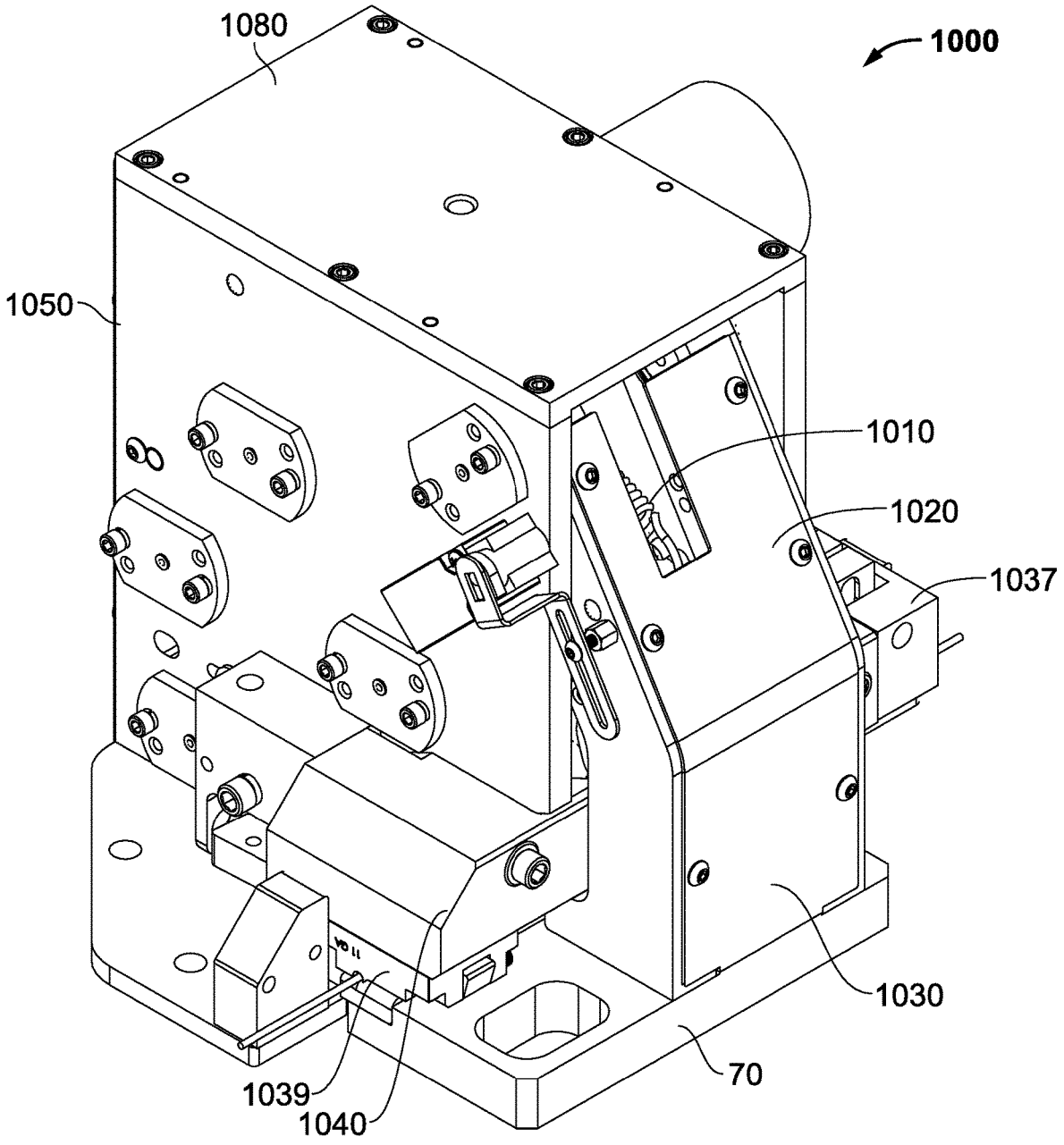
FIG. 11 is a partial side view of the invention in accordance with an embodiment of the invention.
Figure 12:
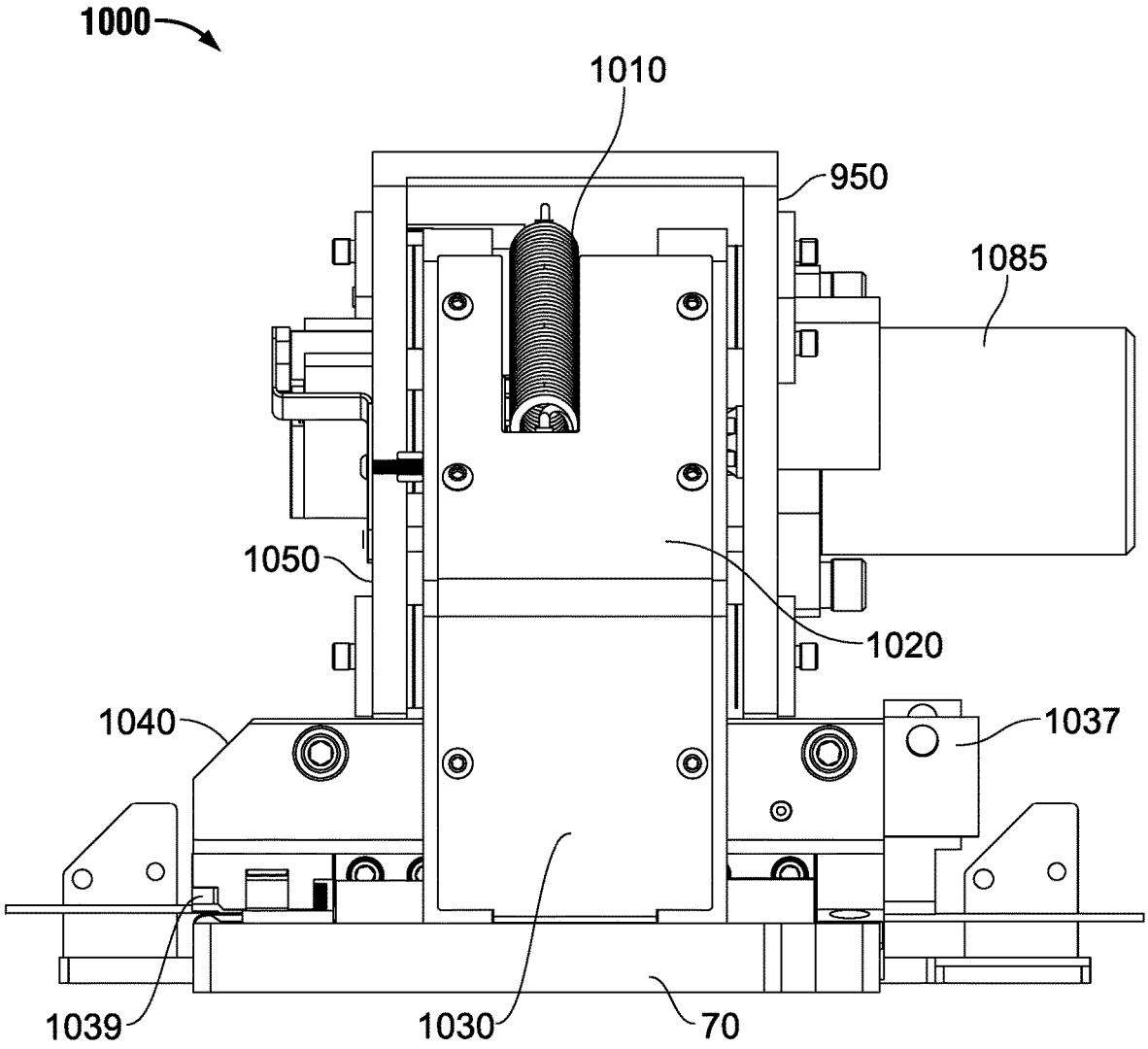
FIG. 12 is a front facing view, in accordance with an embodiment of the invention.

FIG. 11 is a partial side view of the invention in accordance with an embodiment of the invention. As shown in this embodiment, an exemplary wire tying mechanism 1000 comprises a cover lever pivot block 1035 (FIG. 12). As shown, in several embodiments, the wire tying mechanism 1000 is further comprised of a knotter housing top 1080, knotter housing left side 1050, knotter housing right side (FIG. 12), angled safety cover 1020 and bottom safety cover 1030. In several embodiments the a knotter housing top 1080, knotter housing left side 1050, knotter housing right side (not shown), angled safety cover 1020 and bottom safety cover 1030 can be comprised of a solid material utilized in the wire tier industry, which can include, but is not limited to metal, composite materials or synthetic materials.

Figure 13:
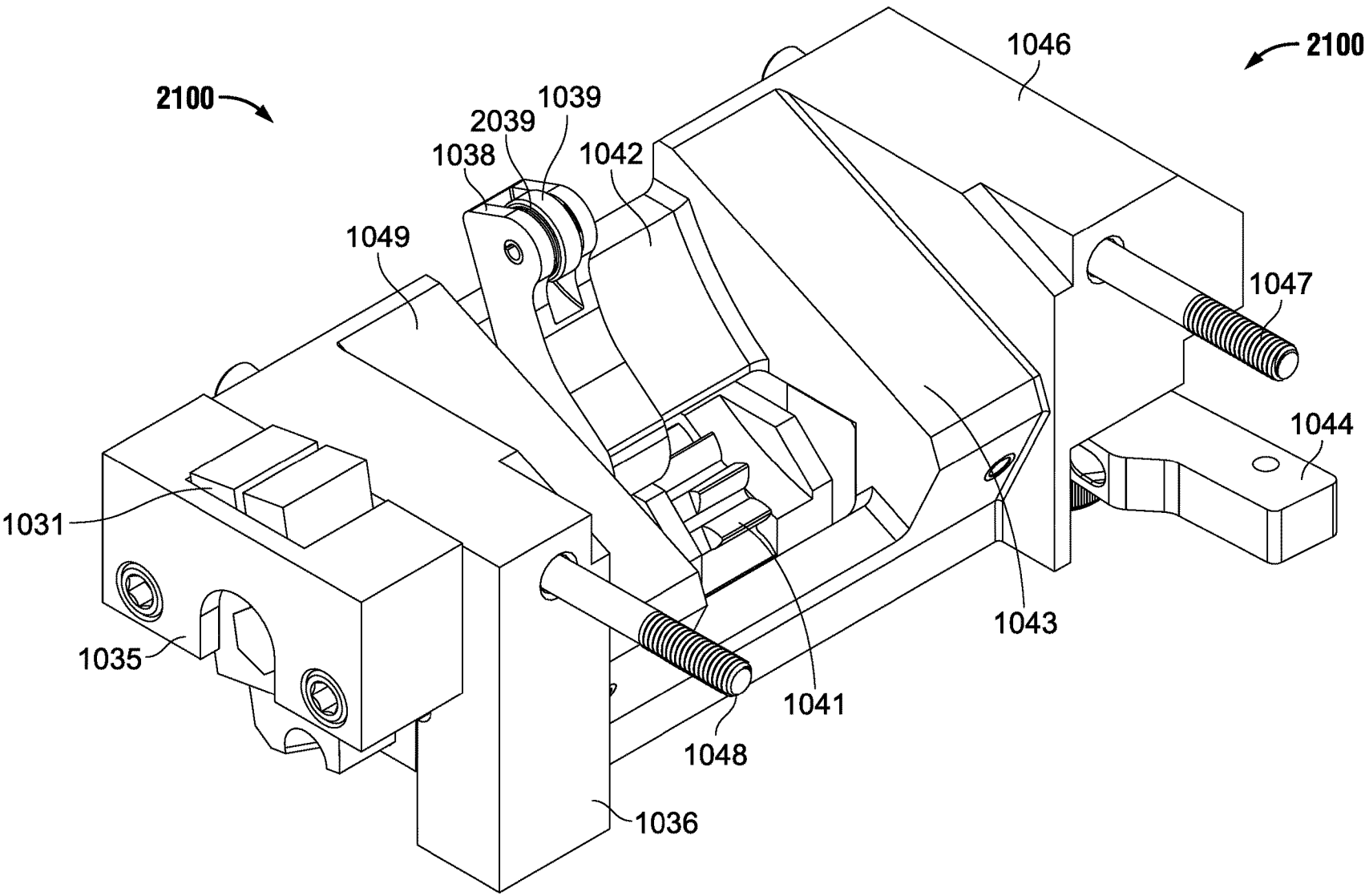
FIG. 13 is a partial side view from the back of the wire release mechanism, in accordance with an embodiment of the invention.

FIG. 11 further illustrates one embodiment of a gripper yoke 1039 and parts cartridge 1040. In several embodiments, gripper yoke 1039 functions, about the hinge, to move between an open and closed position wherein a tied wire 30 (FIG. 16) can be released from one embodiment of the wire release mechanism 2100 (FIG. 13). In several embodiments of the present invention there is a parts cartridge 1040 functions to contain parts for the wire tying mechanism 1000. Further shown is knotter cover spring 1010, which in several embodiment functions to cover the internal mechanicals utilized in the wire tying process.

In several embodiments, the present invention is a wire tier with a wire release mechanism that features a non-reciprocating, single direction rotary knotting sequence. In several embodiments, the present invention utilizes single rotary operation. In several embodiments of the present invention, the present invention utilizes a 4-twist knot. In several embodiments of the present invention, the present invention can be installed or retrofitted on existing wire tier frames.

Figure 14:
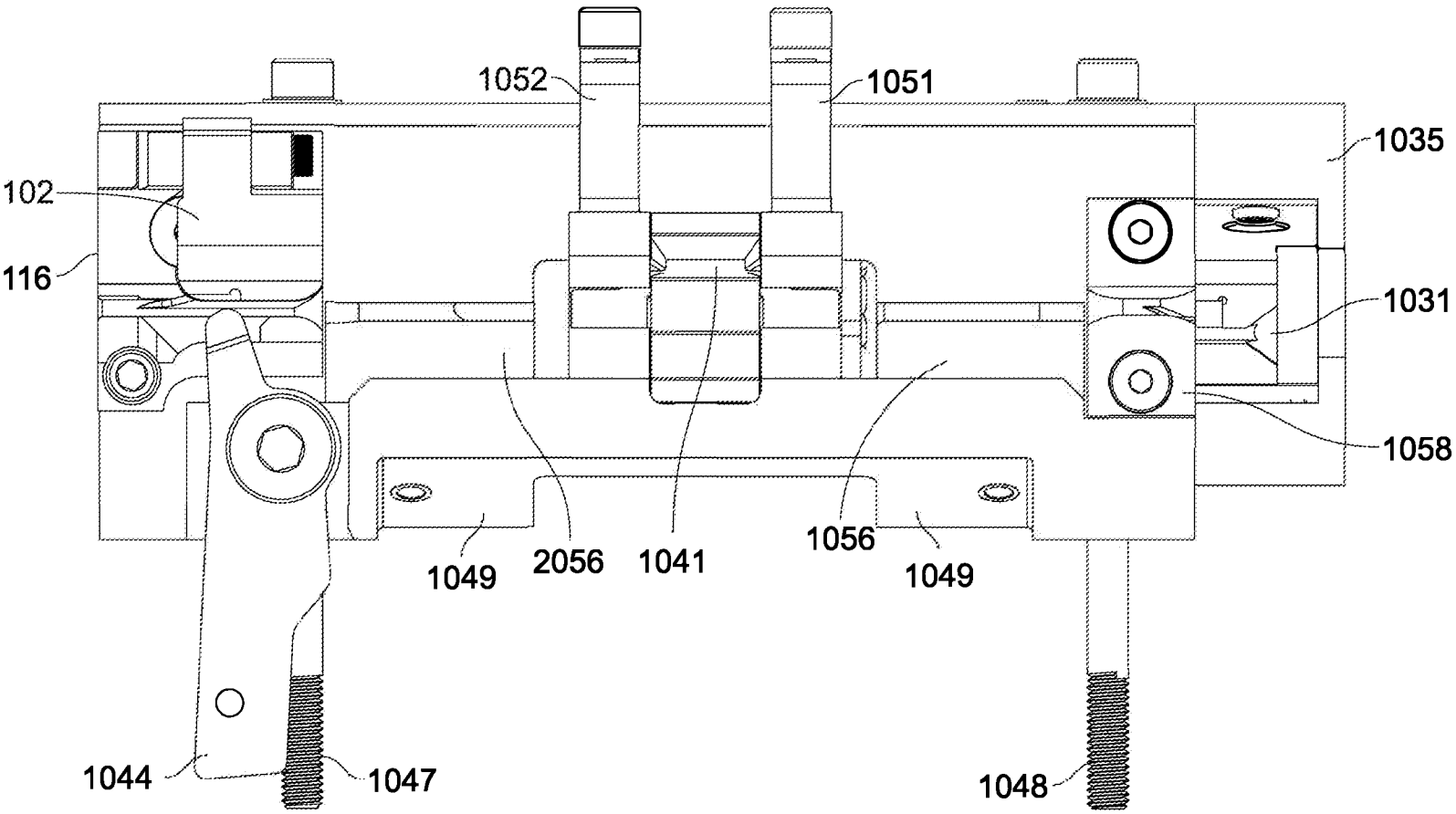
FIG. 14 is bottom view of the invention, in accordance with an embodiment of the invention.
Figure 15:
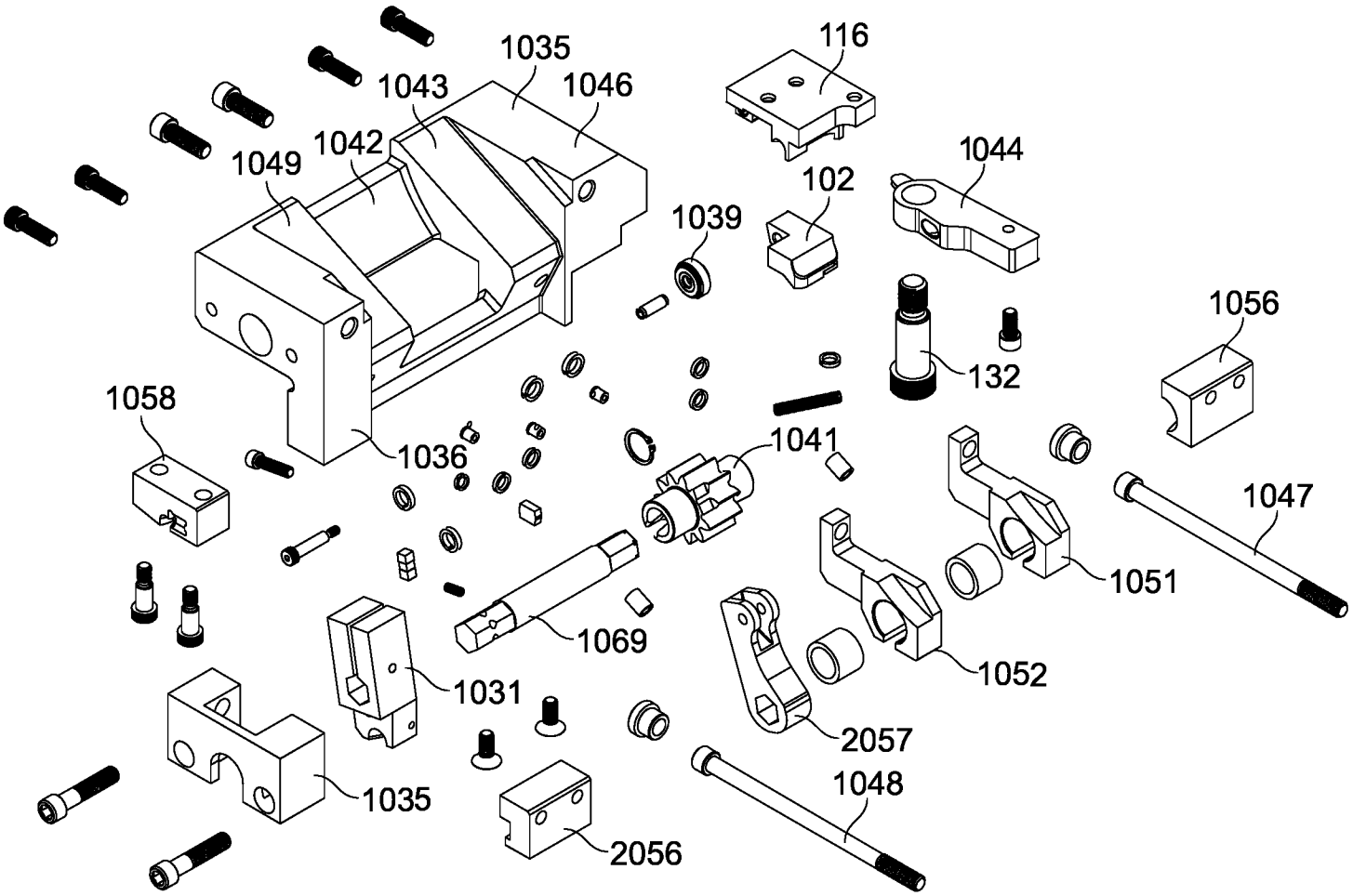
FIG. 15 is partially exploded view of the invention, in accordance with an embodiment of the invention.

As applied to embodiments of the invention as illustrated in FIGS. 11-17, in some embodiments, the rotating arm 70 may be moved between the rearward arm position (as illustrated in FIG. 5) and a forward arm position (as illustrated in FIG. 6). For example, FIG. 5 illustrates a side view of one embodiment of the present invention and depicts the rotating arm 70 in the rearward arm position and the wire release portion 102 in the open position. Further depicted is the gripping arm 126 in the first position and the hydraulic arm 130 in a retracted position. In the illustrated embodiment, the rotating arm 70 is positioned adjacent to the wire release portion 102 but is not mechanically coupled to the wire release portion 102. Hence, in the illustrated embodiment where the wire release mechanism 100 is positioned on bottom side C and the rotating arm 70 hinges from top side D, the wire release portion 102 may fall to the open position by gravity when the rotating arm 70 is moved to the rearward arm position. The same principles apply to the hinged gripper 102 as illustrated in FIG. 15 which functions in a similar manner to wire release portion 102. Hence, when arm 70 is in the open position, either wire release portion 102 or hinged gripper 102 will open allowing a wire 30 to release by gravity. Ergo, the arm 70 as shown in FIGS. 5-6, applies to several aspects of the present invention.

As applied to embodiments of the invention as illustrated in FIGS. 11-17, in some embodiments of the present invention rotating arm 70 can be in the forward position and the wire release portion 102 in the closed position. Also depicted is the gripping arm 126 in the first position and the hydraulic arm 130 in an extended position. In the illustrated embodiment, the rotating arm 70 is positioned adjacent to the wire release portion 102 but is not mechanically coupled to the wire release portion 102. Hence, in the illustrated embodiment where, the wire release mechanism 100 is positioned on bottom side C and the rotating arm 70 hinges from top side D, the wire release portion 102 may be pressed from bottom side C towards top side D by the rotating arm 70 when the rotating arm 70 is moved to the forward arm position. The same principles apply to the hinged gripper 102 as illustrated in FIG. 15 which functions in a similar manner to wire release portion 102. Hence, when arm 70 is in the closed position, either wire release portion 102 or hinged gripper 1071 will be closed therein preventing a wire 2010 to release by gravity.

FIG. 12 illustrates one embodiment of the present invention in a front facing view. As shown, in several embodiments, the wire tying mechanism 1000 is comprised of a knotter housing left side 1050, knotter housing right side 950, angled safety cover 1020 and bottom safety cover 1030. In several embodiments, knotter housing left side 1050, knotter housing right side 950, angled safety cover 1020 and bottom safety cover 1030 can be comprised of a solid material utilized in the wire tier industry, which can include, but is not limited to metal, composite materials or synthetic materials.

FIG. 12 further illustrates one embodiment of a gripper yoke 1039 and parts cartridge 1040. In several embodiments gripper yoke 1039 functions to move between an open and closed position, about the hinge. In several embodiments of the present invention the parts cartridge 1040 functions to contain parts for the wire tying system 1000. Further shown is knotter cover spring 1010, which in several embodiment functions to act as the countering spring for the internal mechanisms during the wire tying process. In some embodiments of the present invention, there is a drive motor 1085 which actuates the wire tying mechanism 1000 and wire release mechanism 3000. In several embodiments, the drive motor 1085 can be electric or hydraulic. In several embodiments of the drive motor can provide the mechanical torque to move the internal gears to initiate a wire tying cycle and/or wire release cycle. As further shown in FIG. 13, in one embodiment of the present invention there is cutter lever cover 1035. In several embodiments of the present invention, cutter lever cover houses the cartridge (cutter lever) box 1035 which is in mechanical communication with cutter insert 1031. Further illustrated is arm 70 which can open and retract.

FIG. 13 is a partial side view from the back of the wire release mechanism 2100, in accordance with an embodiment of the invention. As shown, in several embodiments are parts cartridge blocks 1036, 1042, 1043, 1046, and 1049 which are preferably designed to engage several of the moving portions of the present invention. In several embodiments of the present invention, cutter lever cover houses the cartridge (cutter lever) box 1035 which is in mechanical communication with cutter lever 1031. As illustrated are bolts 1048 and 1047 designed to secure the parts cartridges 1036 and 1046 respectively. In several embodiments of the present invention, cutter lever arm 1038 is attached and in mechanical communication with needle track roller 2039. In several embodiments of the present invention, cutter lever arm 1038 and needle roller track 2039 operate in the following manner to rotate the shaft.

FIG. 13 is a partial side view from the back of the wire release mechanism 2100, in accordance with an embodiment of the invention. In several embodiments of the present invention, gripper lever 1044 is illustrated and can function to actuate the release of a gripped wire. Further illustrated is twister pinion 1041, which in operation functions to contain a wire 30 to be tied and then release said wire through the egress in twister pinion 1041.

FIG. 14 is a front view from the bottom of the invention, in accordance with an embodiment of the invention. As shown, in several embodiments, pinion bushings 1052 and 1051 are designed to frame twister pinion 1041 then in causing two endcaps restraining twister pinion 1041. Further illustrated is hinged gripper 102 which in many embodiments of the present invention functions to grip a wire 30 (FIG. 16) during operation. Also illustrated is gripper lever 1044. In several embodiments of the present invention, cutter lever cover houses the cartridge (cutter lever) box 1035 which is in mechanical communication with cutter insert 1031. As illustrated are bolts 1048 and 1047 designed to secure the parts cartridges 1036 and 1046 respectively (see FIG. 13). Parts cartridge block 1049 is also illustrated. As illustrated, in some embodiments is wire guide cutter side 2056. As illustrated, in some embodiments is wire guide gripper side 1056 and wire guide cutter side 2056.

FIG. 15 is partially exploded view of the invention, in accordance with an embodiment of the wire release portion of the present invention. As shown, in several embodiments are parts cartridge blocks 1036, 1042, 1043, 1046, and 1049 which are preferably designed to engage several of the moving portions of the present invention. As illustrated are bolts 1048 and 1047 designed to secure the parts cartridges 1036 and 1046 respectively. Further shown is gripper yoke 1039, which in several embodiments is designed to move between an open and closed position, about the hinge.

Figure 16:
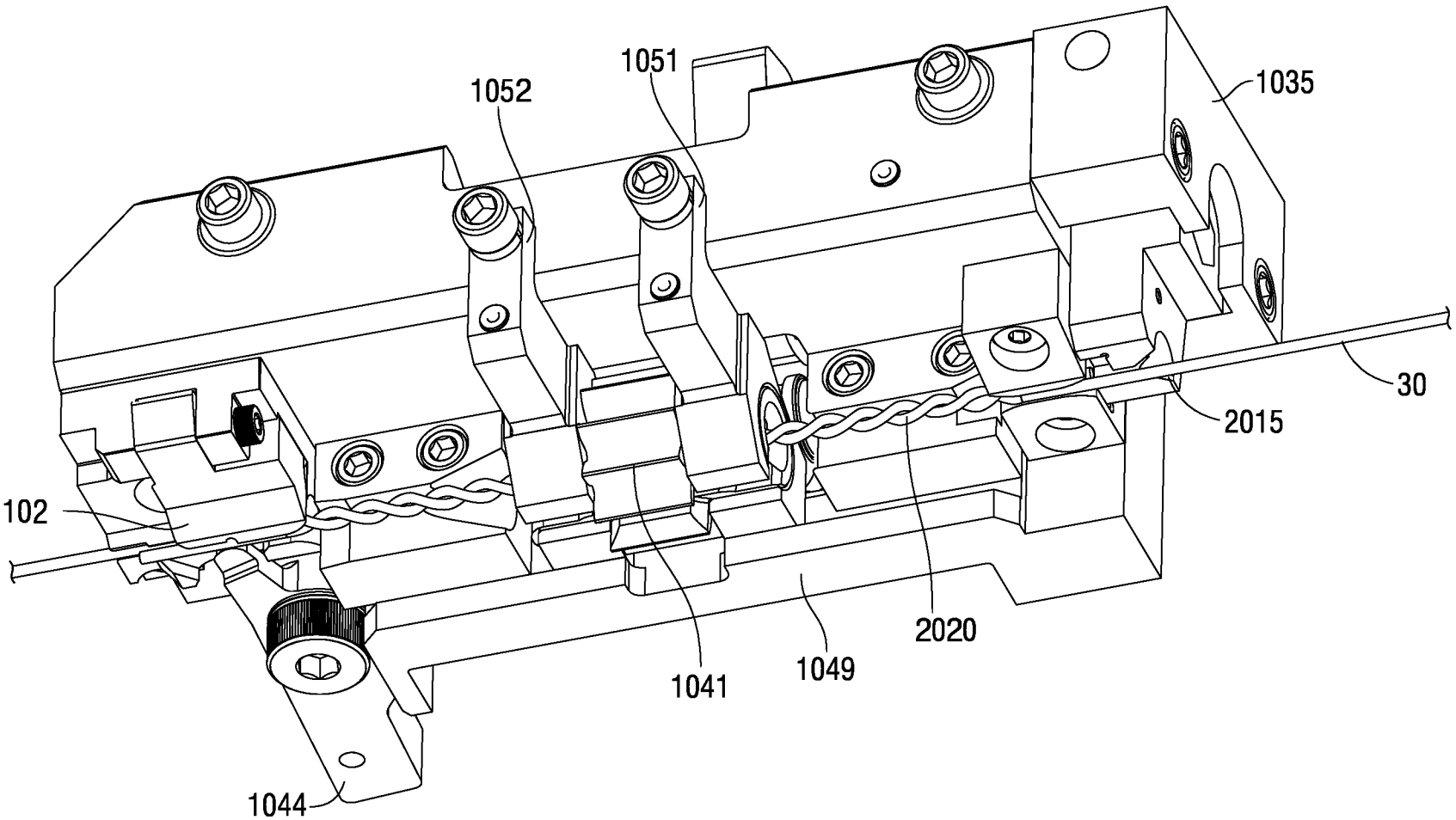
FIG. 16 is a rotated front view from the bottom of the invention, in accordance with an embodiment of the invention.

Further shown is cutter yoke 1058, which in several embodiments is designed to hold the cutting mechanism utilized to cut a wire 30 (FIG. 16). Further shown is hinged gripper 102, which in several embodiments is designed to hold a wire 30 in place during a wire tying circuit. In several embodiments of the present invention, gripper lever 1044 is illustrated and can function to actuate the release of a gripped wire. As shown, in several embodiments, pinion bushings 1052 and 1051 are designed to frame twister pinion 1041 then in causing two endcaps restraining twister pinion 1041. Further illustrated is base 116 In several embodiments, the moving elements as illustrated in FIG. 15, are in mechanical communication with or attached to the base 116.

Further illustrated is gripper pivot bolt 132 which in many embodiments of the present invention functions to act as a pivot for gripper lever 1044. Further shown is cutter lever arm 2057 which is designed to rotate cutter lever 1031. Further shown is cutter shaft 1069 which is designed to attach to the cutter lever arm 2057 and rotate said arm. Further shown is parts cartridge block 1036 which is designed to cover various parts. Further shown is wire guide (gripper side) 1056 which is designed to guide a wire 30 during operation.

FIG. 16 is a rotated front view from the bottom of the invention, in accordance with an embodiment of the invention. As shown, in several embodiments of the present invention is wire 30, which in several embodiments can be a wire of hi-tensile wire grade. Further shown in several embodiments, is wire track 2015, which is designed to guide the wire 30 during a tying and cutting procedure. As further shown is wire twist section 2020 which in several embodiments of the present invention is a twisted or tied wire portion. Further shown in several embodiments of the present invention, cutter lever cover houses the cartridge (cutter lever) box 1035 which is in mechanical communication with cutter insert 1031. As shown, in several embodiments, pinion bushings 1052 and 1051 are designed to frame twister pinion 1041 then in causing two endcaps restraining twister pinion 1041. In several embodiments, the twister pinion 1041 is constructed with outer teeth, a hollow interior and an ingress portion to allow for a wire 30 to egress from the twister pinion 1041 then a wire 30 is released. Further illustrated is hinged gripper 102 which in many embodiments of the present invention functions to act as a pivot for gripper lever 1044. Also illustrated is gripper lever 1044.

Figure 17:
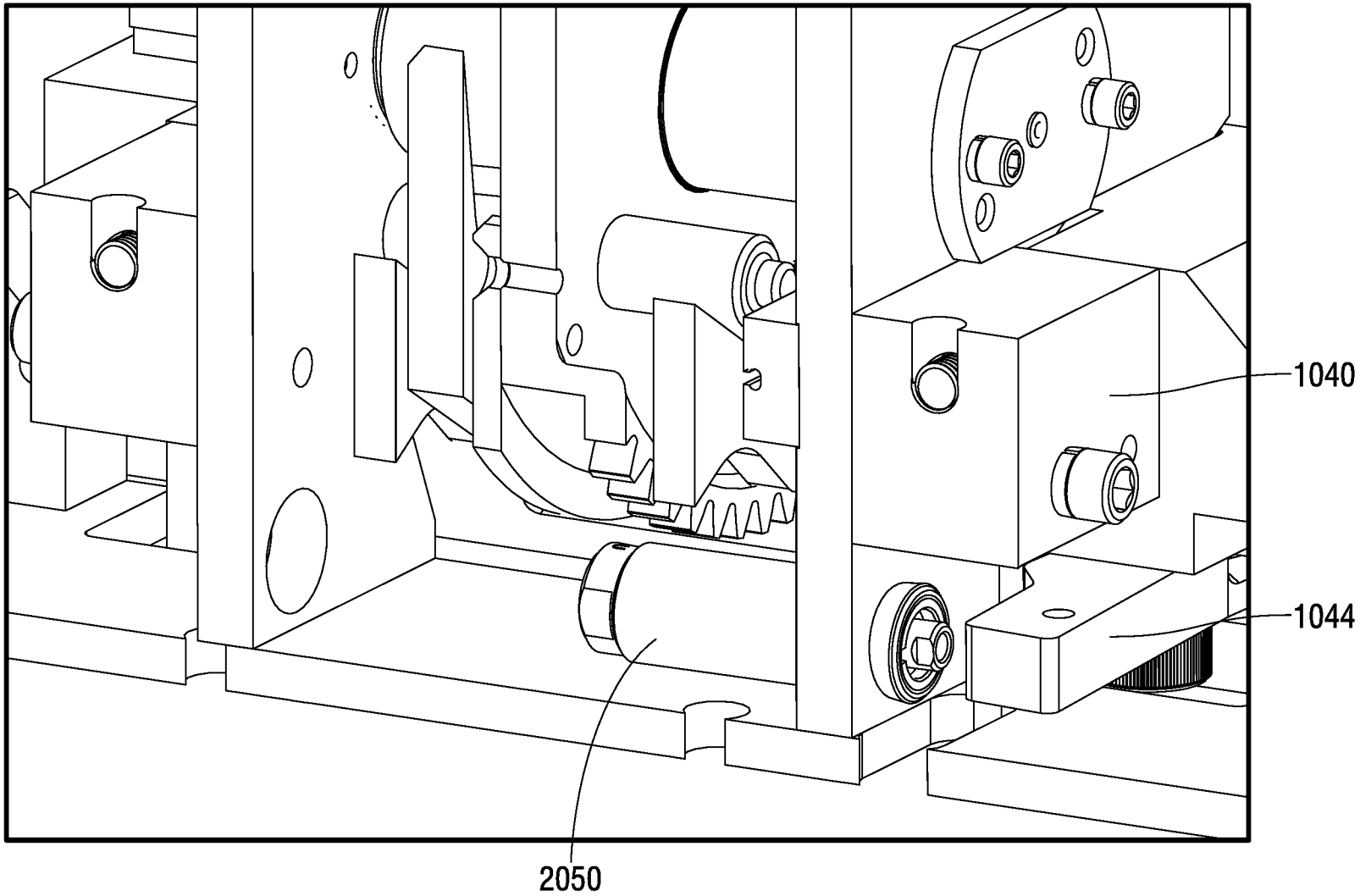
FIG. 17 is a cross-sectional view of the invention, in accordance with an embodiment of the invention.

FIG. 17 is a cross-sectional view of the invention, in accordance with an embodiment of the invention. Illustrated is gripper lever 1044. In several embodiments of the present invention, gripper lever 1044 is illustrated and can function to actuate the release of a gripped wire 2010. In several embodiments of the present invention the parts cartridge 1040 functions to contain parts for the wire tying system 1000. Further illustrated is cylinder 2050, which in operation can function to extend thereby pushing gripper lever 1044 and causing it to rotate and release a wire tied portion 2020.

Figure 18:
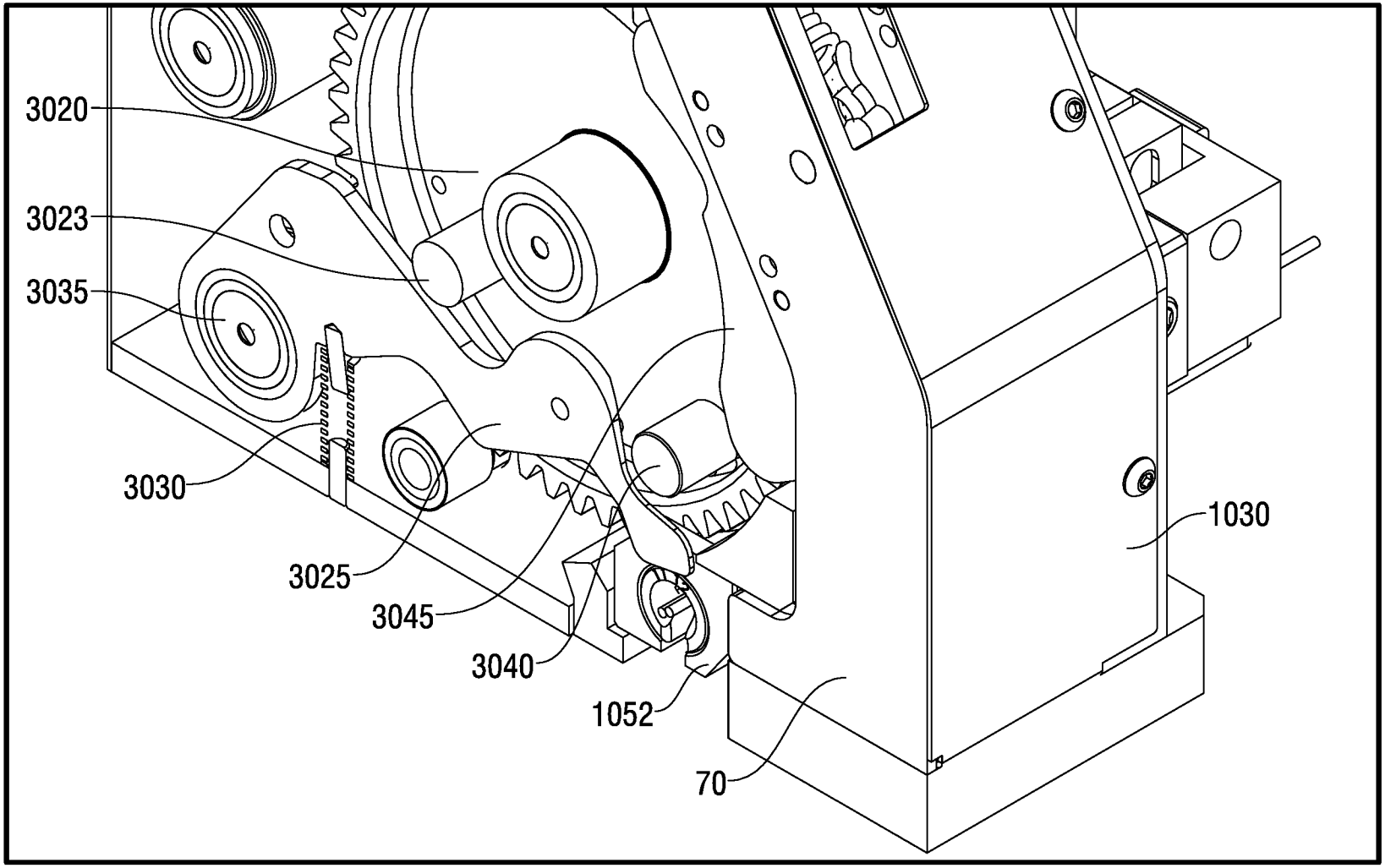
FIG. 18 is a cross-sectional view of the invention, in accordance with an embodiment of the invention with a focus on the pushing arm.

FIG. 18 is a cross-sectional view of the invention, in accordance with an embodiment of the invention with a focus on the pushing arm. As illustrated, in one embodiment of the present invention there is an internal main cog 3020. In several embodiments, internal main cog has an engagement column 3023 and a second engagement column 3040. Further shown is arm eject cam 3045 and ejector 3025. In several embodiments ejector 3025 is engaged and can rotate about pivot 3035. Ejector 3025 is also in mechanical engagement with spring 3030. Further shown is arm 70 and bushing 1052 with a wire egress slot.

In several embodiments of the present invention, the invention operates in part when internal cog rotates (in a counter clockwise fashion) column 3023 engages the surface of ejector 3025 forcing ejector 3025 to rotate downward about the pivot 3035 and to interface with bushing 1052 therein pushing a wire 30 (if a wire tying cycle is being run) out of the bushing 1052 and 1051 as well as the egress slot of the twister pinion 1041. Substantially simultaneously, column 3040 engages the eject cam 3045 of the arm 70 causing said arm 70 to raise up, which will disengage the hinged gripper 102 and the engaged wire 30 (if a wire tying cycle is run) at the same time as the wire is disengaged from the twister pinion 1041.

In several embodiments, the present invention is a wire release mechanism comprising: a gripper lever; a gripper pivot bolt; a gripper yoke; a hinged gripper with an engagement face; a cutter lever arm; a cutter yoke; a cutter shaft; a cylinder; a twister pinion with outer teeth, a hollow interior and an ingress portion; pinion bushings; and a wire guide; wherein said gripper lever is in mechanical and rotatable communication with said gripper pivot bolt and is actuated into movement about said gripper pivot bolt by said cylinder, said hinged gripper is in mechanical and rotatable communication with said gripper yoke; said twister pinion with outer teeth, a hollow interior and an ingress portion is rotatable and in mechanical communication with said pinion bushings; and said a cutter lever arm is in mechanical communication with said cutter yoke and said cutter shaft wherein movement of said cutter lever arm will rotate said cutter shaft. In several embodiments, said wire release mechanism is in mechanical communication with a wire tying assembly. In several embodiments, said gripper lever is rotated into an open position about said gripper pivot bolt by the expansion of said cylinder. In several embodiments, said gripper lever is rotated into a closed position about said gripper pivot bolt by the retraction of said cylinder. In several embodiments, said hinged gripper with an engagement face is in a closed position relative to said gripper yoke in which said hinged gripper with an engagement face has the engagement face substantially parallel to the gripper yoke. In several embodiments, said hinged gripper with an engagement face is in a closed position relative to said gripper yoke in which said hinged gripper with an engagement face has the engagement face at an angle to the gripper yoke. In several embodiments, said ingress portion allows for a wire to egress said twister pinion. In several embodiments, the wire release mechanism further comprises a set of pushing arms; wherein said pushing arms can push a wire out of said ingress portion.

In certain embodiments of the present invention, grippers lever 1044 gets rotated about the pivot bolt 102. When rotated by movement of the cylinder gripper lever 1044 rotates there and releasing contact with the wire. The hinged gripper 102 functions to hold the wire in place during the wire tie operation with gripper lever 1044. Cutter yokes and shafts function to actually cut the wire during certain times upon the wire being rotated. Pinion 1041 coupled with cutter shaft work to rotate to move the cutter to facilitate cutting motion.

From the foregoing, it will be seen that this invention is one well adapted to attain all the ends and objects hereinabove set forth, together with other advantages, which are obvious and inherent to the structure, it will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

I claim:

1. A wire release mechanism comprising:

a gripper lever;

a gripper pivot bolt;

a gripper yoke;

a hinged gripper with an engagement face;

a cutter lever arm;

a cutter yoke;

a cutter shaft;

a cylinder;

a twister pinion comprising a plurality of outer teeth, a hollow interior, and an ingress portion;

pinion bushings; and a wire guide; wherein said gripper lever is in mechanical and rotatable communication with said gripper pivot bolt and is actuated into movement about said gripper pivot bolt by said cylinder;

said hinged gripper is in mechanical and rotatable communication with said gripper yoke;

said twister pinion with outer teeth, a hollow interior and an ingress portion is rotatable and in mechanical communication with said pinion bushings; and said cutter lever arm is in mechanical communication with said cutter yoke and said cutter shaft, and is attached to said cutter shaft, and wherein movement of said cutter lever arm will rotate said cutter shaft.

2. The wire release mechanism of claim 1 wherein:

said gripper lever is rotated into an open position about said gripper pivot bolt by the expansion of said cylinder.

3. The wire release mechanism of claim 1 wherein:

said gripper lever is rotated into a closed position about said gripper pivot bolt by the retraction of said cylinder.

4. The wire release mechanism of claim 1 wherein:

said hinged gripper with an engagement face is in a closed position relative to said gripper yoke in which said hinged gripper with an engagement face has the engagement face substantially parallel to the gripper yoke.

5. The wire release mechanism of claim 1 wherein:

said hinged gripper with an engagement face is in a closed position relative to said gripper yoke in which said hinged gripper with an engagement face has the engagement face at an angle to the gripper yoke.

6. The wire release mechanism of claim 1 wherein:

said ingress portion allows for a wire to egress said twister pinion.

7. The wire release mechanism of claim 6 wherein:

a set of pushing arms; wherein said pushing arms can push a wire out of said ingress portion.

8. A method of completing a wire tying cycle using the wire release mechanism of claim 1, the method comprising the steps of:

moving, using the cylinder, a wire release portion to a closed position, the wire release portion comprising the gripper lever;

advancing a wire;

gripping at least one end of the wire by pressing the wire against the engagement face of the hinged gripper with a retractable surface of the wire tying assembly, the retractable surface being provided by the gripper lever;

tying the wire, cutting the wire using the cutter lever arm, and moving the wire release portion to the open position to release at least one end of the wire.

* * * * *